US011063345B2

(12) United States Patent
Mui

(10) Patent No.: US 11,063,345 B2
(45) Date of Patent: Jul. 13, 2021

(54) SYSTEMS AND METHODS FOR PROVIDING A WEARABLE ANTENNA

(71) Applicant: MASTODON DESIGN LLC, Rochester, NY (US)

(72) Inventor: Andrew Mui, Rochester, NY (US)

(73) Assignee: MASTODON DESIGN LLC, Rochester, NY (US)

( * ) Notice: Subject to any disclaimer, the term of this patent is extended or adjusted under 35 U.S.C. 154(b) by 95 days.

(21) Appl. No.: 16/573,440

(22) Filed: Sep. 17, 2019

(65) Prior Publication Data

US 2020/0185817 A1 Jun. 11, 2020

Related U.S. Application Data

(60) Provisional application No. 62/699,018, filed on Jul. 17, 2018.

(51) Int. Cl.

| | |
|---|---|
| ***H01Q 1/27*** | (2006.01) |
| ***H01Q 9/30*** | (2006.01) |
| ***H01R 13/58*** | (2006.01) |

(52) U.S. Cl.
CPC ..... *H01Q 1/273* (2013.01); *H01Q 9/30* (2013.01); *H01R 13/5845* (2013.01)

(58) Field of Classification Search
CPC ..... H01Q 1/46; H01Q 1/40; H01Q 9/16
See application file for complete search history.

(56) References Cited

U.S. PATENT DOCUMENTS

| | | | | |
|---|---|---|---|---|
| 2,802,210 | A * | 8/1957 | Berndt | H01Q 9/18 343/792 |
| 3,720,874 | A * | 3/1973 | Gorcik | H04B 1/385 455/90.3 |
| 4,032,921 | A * | 6/1977 | Sikina, Jr. | H01Q 9/27 343/730 |
| 4,352,109 | A * | 9/1982 | Reynolds | H01Q 9/28 343/792 |
| 4,626,862 | A * | 12/1986 | Ma | H01Q 1/243 343/702 |
| 4,730,195 | A * | 3/1988 | Phillips | H01Q 9/18 343/727 |
| 5,301,687 | A * | 4/1994 | Wong | A61B 18/1815 606/33 |
| 5,526,003 | A * | 6/1996 | Ogawa | H01Q 1/273 343/700 MS |
| 5,617,105 | A * | 4/1997 | Tsunekawa | H01Q 1/24 343/702 |

(Continued)

FOREIGN PATENT DOCUMENTS

WO 20131028052 A1 2/2013

*Primary Examiner* — Graham P Smith
*Assistant Examiner* — Jae K Kim
(74) *Attorney, Agent, or Firm* — BakerHostetler

(57) ABSTRACT

The present disclosure pertains to an antenna assembly configured to inconspicuously provide mobile communication in rugged or tactical environments. Some embodiments may include: a flexible conductor configured to receive and/or emit electromagnetic radiation; a printed circuit board (PCB) configured to match characteristic impedances; and a connector configured to mate with another connector associated with a radio or amplifier, the PCB being potentially disposed within an interior portion of the connector of the antenna assembly.

13 Claims, 17 Drawing Sheets

(56) References Cited

U.S. PATENT DOCUMENTS 5,928,145 A 7/1999 Ocali et al.
6,051,018 A * 4/2000 Larsen ..... A61B 18/18 607/101
6,135,786 A * 10/2000 Johnson ..... H01R 31/065 439/131
6,229,495 B1 * 5/2001 Lopez ..... H01Q 9/32 343/702
7,164,933 B1 * 1/2007 Steigerwald ..... H01Q 1/243 455/129
7,782,264 B1 * 8/2010 Vincent ..... H01Q 9/32 343/745
9,130,274 B1 * 9/2015 Vincent ..... H01Q 9/32
10,446,922 B1 10/2019 Mui
2003/0107524 A1 * 6/2003 Hart ..... H01Q 21/24 343/860
2005/0062659 A1 * 3/2005 Packer ..... H01Q 1/273 343/718
2006/0116097 A1 * 6/2006 Thompson ..... H04B 17/318 455/232.1
2007/0015416 A1 * 1/2007 Gutierrez ..... H01R 24/64 439/676
2007/0089293 A1 * 4/2007 Pitzele ..... H05K 7/1417 29/855
2007/0233057 A1 * 10/2007 Konishi ..... A61B 18/1477 606/33
2007/0257854 A1 * 11/2007 Guo ..... H01Q 9/30 343/790
2008/0204326 A1 * 8/2008 Zeinolabedin Rafi ..... H01Q 9/0414 343/700 MS
2008/0303609 A1 * 12/2008 Abe ..... H04B 3/56 333/124
2009/0079656 A1 * 3/2009 Peyla ..... H01Q 1/46 343/860
2009/0102726 A1 * 4/2009 Imano ..... H01Q 21/28 343/702
2010/0156748 A1 * 6/2010 Hwang ..... H01Q 1/243 343/860
2011/0074644 A1 * 3/2011 Wertman ..... H01Q 1/273 343/718
2011/0128708 A1 6/2011 Blake et al.
2011/0232671 A1 * 9/2011 Bouix ..... A46B 15/003 132/218
2011/0309994 A1 * 12/2011 Kato ..... H01Q 1/50 343/860
2012/0077448 A1 * 3/2012 Yagi ..... H01Q 9/42 455/90.2
2012/0119959 A1 * 5/2012 Mashima ..... H01Q 1/46 343/702
2012/0119964 A1 * 5/2012 Ngo Bui Hung ..... H01Q 9/30 343/787
2012/0182196 A1 * 7/2012 Ngo Bui Hung ..... H01Q 5/00 343/792
2012/0274529 A1 * 11/2012 Yoshino ..... H01Q 9/26 343/791
2012/0287582 A1 * 11/2012 Vinciarelli ..... H01F 27/2804 361/728
2013/0044038 A1 2/2013 Packer
2013/0235982 A1 * 9/2013 Chen ..... G01T 7/00 378/189
2013/0281036 A1 * 10/2013 Kolokotronis ..... H04B 17/101 455/115.1
2014/0329405 A1 * 11/2014 Hsieh ..... G02B 6/4272 439/485
2014/0340267 A1 * 11/2014 Kim ..... H01Q 1/32 343/713
2015/0029059 A1 * 1/2015 Grossman ..... H01Q 7/00 343/702
2015/0042523 A1 2/2015 Sivalingam
2015/0116181 A1 * 4/2015 Williams ..... H01Q 1/242 343/860
2016/0081446 A1 * 3/2016 Maddox ..... A45F 3/14 224/257
2016/0087334 A1 * 3/2016 Sayama ..... H01Q 9/16 343/820
2016/0164182 A1 * 6/2016 Lai ..... H01Q 21/0006 343/905
2016/0240909 A1 * 8/2016 Barnett ..... H01P 5/085
2017/0133764 A1 * 5/2017 Tinaphong ..... H01Q 1/2291
2018/0013245 A1 * 1/2018 Li ..... A61N 1/3754
2018/0235351 A1 * 8/2018 Caldwell ..... H04B 1/385
2019/0074624 A1 * 3/2019 Dendas ..... H01R 12/85
2019/0098778 A1 * 3/2019 Pandey ..... H05K 5/0065
2019/0144254 A1 * 5/2019 Hutchinson ..... B67D 1/1247 222/1

* cited by examiner

SYSTEMS AND METHODS FOR PROVIDING A WEARABLE ANTENNA

CROSS-REFERENCE TO RELATED APPLICATIONS

This application claims the benefit of priority of U.S. provisional application No. 62/699,018 filed Jul. 17, 2018 entitled "Flexible Base Loaded Broadband Antenna and Methods," the contents of which is incorporated by reference in its entirety.

TECHNICAL FIELD

The present disclosure relates generally to systems and methods for providing a wearable antenna assembly that may be attached to a radio unit and an article of clothing. More specifically, it relates to a flexible, broadband antenna that improves upon rigid antennas and that eliminates need for intervening adapters.

BACKGROUND

Typical radio setups require an antenna coupled to a coaxial cable via a first adapter, with the coaxial cable couplable to the radio via a second adapter. Each of the adapters introduces additional loss in signal strength and stability. The signal losses caused by the adapters in turn reduce the battery life of the radio assembly and decrease a performance range of the antenna. In addition, current coaxial cables do not include an antenna integrated therein, and instead include few components—an outer jacket, an internal metallic braid, insulating material, and a central conductor—to transmit an electrical signal through an adapter to a radio.

Antennas are typically formed of a rigid metal because the potential losses caused by the adapters necessitate high-quality signal strength to overcome the losses. Rigid antennas are useful when the antennas are designed to remain substantially stationary, such as permanently installed antennas for use in a home.

Rigidity can be problematic for mobile applications, such as radio antennas used by law enforcement and military personnel. For example, a soldier in the field typically must carry a radio and a separately-mounted, rigid antenna, with the components being coupled via an additional piece of coaxial cable and secured via straps. Such a configuration encumbers the wearer with additional weight and additional component parts, thereby forcing the wearer to carry awkwardly-connected pieces. For a military or law enforcement application, such encumbrances at least can lead to inefficient movement, interference with other worn equipment, and greater visibility (e.g., due to a protrusive antenna) to enemies, which can ultimately endanger the safety of the wearer.

SUMMARY

The foregoing needs are met, to a significant extent, by the disclosed systems and methods. Accordingly, one or more aspects of the present disclosure relate to a method for manufacturing or otherwise providing a flexible, base-loaded broadband antenna. This antenna may be configured to inconspicuously provide mobile communication in rugged environments, and it may facilitate communication without need of any lossy adapters. Some exemplary embodiments may include: a flexible conductor configured to receive and/or emit electromagnetic radiation; a printed circuit board (PCB) configured to match characteristic impedances; and a connector configured to mate with another connector associated with a radio or amplifier, the PCB being potentially integrated into an interior portion of the connector of the antenna assembly.

Implementations of any of the described techniques and architectures may include a method or process, an apparatus, a device, a machine, or a system.

BRIEF DESCRIPTION OF THE DRAWINGS

The details of particular implementations are set forth in the accompanying drawings and description below. Like reference numerals may refer to like elements throughout the specification. Other features will be apparent from the following description, including the drawings and claims. The drawings, though, are for the purposes of illustration and description only and are not intended as a definition of the limits of the disclosure.

DETAILED DESCRIPTION

Figure 1:
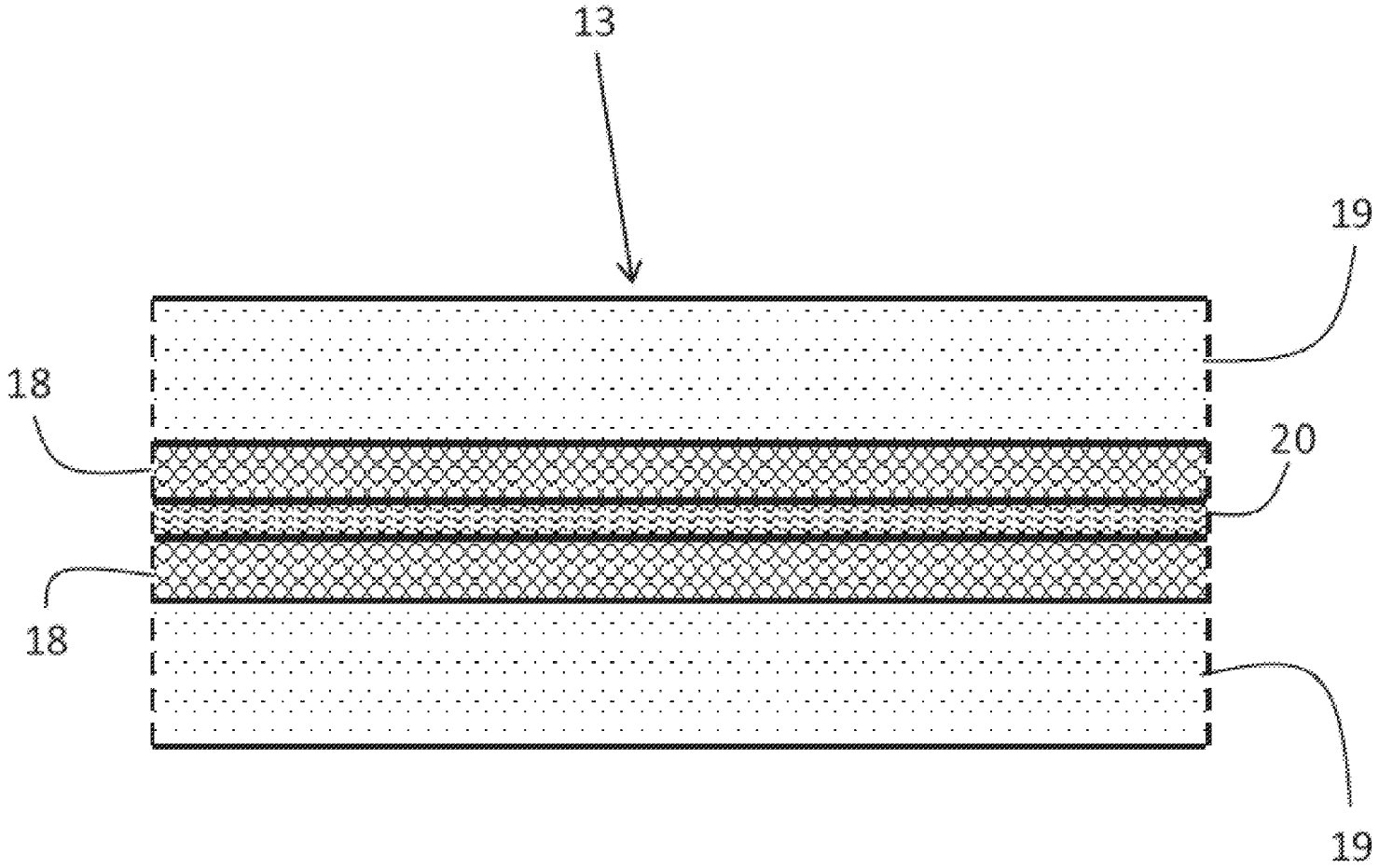
FIG. 1 illustrates a cross-section orthogonal view of the interior components of a coaxial cable, in accordance with one or more embodiments.

As used throughout this application, the word "may" is used in a permissive sense (i.e., meaning having the potential to), rather than the mandatory sense (i.e., meaning must). The words "include," "including," and "includes" and the like mean including, but not limited to. As used herein, the singular form of "a," "an," and "the" include plural references unless the context clearly dictates otherwise. As employed herein, the term "number" shall mean one or an integer greater than one (i.e., a plurality).

As used herein, the statement that two or more parts or components are "coupled" shall mean that the parts are joined or operate together either directly or indirectly, i.e., through one or more intermediate parts or components, so long as a link occurs. As used herein, "directly coupled" means that two elements are directly in contact with each other. As used herein, "fixedly coupled" or "fixed" means that two components are coupled so as to move as one while maintaining a constant orientation relative to each other. Directional phrases used herein, such as, for example and without limitation, top, bottom, left, right, upper, lower, front, back, and derivatives thereof, relate to the orientation of the elements shown in the drawings and are not limiting upon the claims unless expressly recited therein.

These drawings may not be drawn to scale and may not precisely reflect structure or performance characteristics of any given embodiment, and should not be interpreted as defining or limiting the range of values or properties encompassed by example embodiments.

An object of the invention is to provide a flexible antenna assembly, including an antenna integrally formed with a coaxial cable, such that mobile applications are more efficient and comfortable by eliminating the need to transport a separately-connected antenna. Some embodiments may have an antenna assembly integrally formed with a flexible coaxial cable, thereby removing the need for loss-inducing adapters between a radio and an antenna. The disclosed antenna assembly may further allow for the efficient and comfortable use of antennas for mobile applications, such as by law enforcement and military personnel in remote locations. Whereas traditional antennas are often rigid, this antenna assembly may be flexible, thereby allowing a user to easily and simultaneously transport and use the antenna.

As used herein, an annular surface may be defined as an end of a hollow cylinder. Bandwidth may be defined as a frequency range over which an antenna assembly can operate. Dipole may be defined as an electrical conductor connected to a radio-frequency feed line, with the dipole having an associated length dictated by a desired lower limit operating frequency. Flexible may be defined as capable of deforming without breaking. Magnetic element may be defined as a component with resistance and positive reactance that inhibits common mode interfering signals from passing therethrough to a radiating element. Operating frequency may be defined as a desired frequency broadcasted or received by an antenna assembly. For example, a lower limit operating frequency may be the lowest frequency that can be received or transmitted by the antenna. Similarly, a higher limit operating frequency is the highest frequency that can be received or transmitted by the antenna. Radiating element may be defined as a component of an antenna assembly that is capable of receiving or transmitting radio frequency (RF) energy. Sheath may be defined as a close-fitting protective covering having a diameter greater than a diameter of the structure that is encased by the sheath.

Some embodiments may include an antenna assembly having a coaxial cable, at least one radiating element, and a flexible outer sheath. The coaxial cable may include an outer jacket that surrounds a metallic shield. The shield may surround an internal conductor such that the outer jacket has an associated diameter greater than a diameter of the metallic shield, and the metallic shield may have a diameter greater than a diameter of the internal conductor. Each radiating element may be adapted to receive and/or transmit radio signals of varying frequencies. In some embodiments, the radiating elements may be metallic sheaths. Alternatively, the radiating elements may be copper braids.

Some embodiments may include a lower limit radiating element having a first annular surface opposite a second annular surface, with a hollow body disposed therebetween joining the first and second annular surfaces together. The first and second annular surfaces may include a diameter that is greater than the diameter of the outer jacket such that the radiating element can surround at least a portion of the coaxial cable. The first annular surface of the lower limit radiating element may couple with the metallic shield disposed within the outer jacket of the cable, thereby allowing a transfer of energy between the lower limit radiating element and the shield. Similarly, the flexible outer sheath may include a first end opposite a second end, with a hollow body disposed therebetween joining the first and second ends together. The outer sheath may include a diameter that is substantially uniform along the hollow body, the diameter being greater than the diameter of the lower limit radiating element, allowing the outer sheath to surround the lower limit radiating element and the coaxial cable.

The lower limit radiating element may be adapted to form a dipole having a length between about ¼ and ½ of a wavelength of a lower limit operating frequency of a radio, such as a receiver or a transmitter to which the radiating element may be electrically coupled via an electrical connector, such as a radio frequency (RF) connector. In some embodiments, the antenna assembly may include a second, higher limit radiating element having a length of less than ⅕ of the wavelength of the lower limit operating frequency. The lower limit and higher limit radiating elements may be separated by an insulating layer, thereby preventing a short circuit.

In some embodiments, the antenna assembly may include at least one magnetic element. The magnetic element may have a diameter greater than the diameter of the outer jacket of the coaxial cable, thereby allowing the magnetic element to surround the coaxial cable. In some embodiments, the magnetic element may be a ferrite having a relative magnetic permeability of approximately 125. The magnetic element may be adapted to prevent external signals from interfering with those received or transmitted by the antenna assemblies, thereby operating as a common mode frequency choke.

The antenna assembly may be retrofitted onto an existing coaxial cable. To retrofit the antenna assembly, a portion of the outer jacket of the coaxial cable may be removed, and the lower limit radiating element may be cut such that it has a length equal to that of the removed portion of the coaxial cable. In some implementations, the length may be ⅖ of the wavelength of the lower limit operating frequency of the radio. After the lower limit radiating element is cut to size, at least a portion of the outer jacket of the coaxial cable may be surrounded with the lower limit radiating element. A higher limit radiating element may at least partially surround the lower limit radiating element, with the radiating elements being separated by an insulating layer. The higher limit radiating element may have a length that is approximately 30% less than a length of the lower limit radiating element, allowing the higher limit radiating element to capture frequencies greater than those captured by the lower limit radiating element. The radiating elements and the coaxial cable may be encased in a flexible outer sheath, thereby forming a flexible antenna assembly with an antenna integrated with an existing coaxial cable. Some embodiments may combine lower and higher limit radiating elements to capture a wide range of frequencies.

As shown in FIG. 1, a traditional coaxial cable 13 includes outer jacket 19, typically made of PVC or other polymer, encasing internal metallic conductor 20, which is typically made of copper or silver. Internal conductor 20 is surrounded by an insulation layer (exemplarily depicted as reference numeral 22 in FIG. 4A) that is disposed between the conductor and the jacket. Similar to outer jacket 19, the insulation layer is typically made of a natural or synthetic polymer; alternatively, the insulation layer may be made of a gel. The coaxial cable also includes metallic shield 18 (alternatively, shield 18 may be commonly referred to as a sheath or a braid). Shield 18 surrounds internal conductor 20. In addition, other components may be present, such as additional aluminum shields to prevent signal interference.

Each component of coaxial cable 13 performs a function that is essential to the efficiency and efficacy of the cable. For example, outer jacket 19 encases the internal components, holding the components together in a relatively uniform shape. Internal conductor 20 transmits the cable's signal to an external electrical device, such as a television or radio. Metallic shield 18 prevents external signals from interfering with that of internal conductor 20 by intercepting the signals. To prevent a short circuit of the cable via a direct connection between internal conductor 20 and shield 18, coaxial cable 13 includes the insulation layer, which provides a spacer between internal conductor 20 and metallic shield 18.

Figure 2:
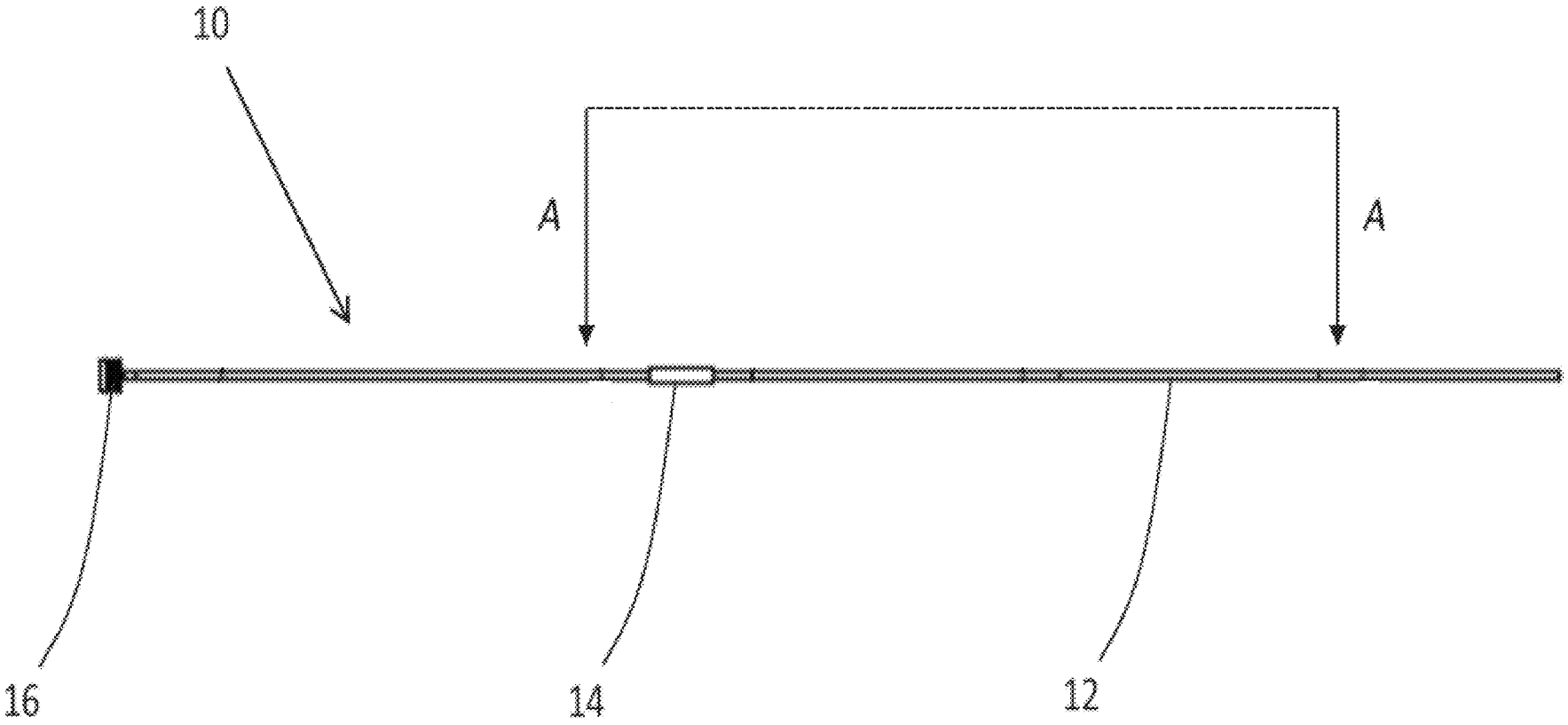
FIG. 2 illustrates an orthogonal view of an exterior surface of a flexible broadband antenna assembly, in accordance with one or more embodiments.

As shown in FIG. 2, an embodiment of antenna assembly 10 includes dipole assembly 12, magnetic element 14, and radio connector 16. Each of the components of antenna assembly 10 are in electrical communication with each other, allowing for electrical signals to be received and/or transmitted by antenna assembly 10. Specifically, the electrical signals are received and/or transmitted by dipole assembly 12, and are transmitted to coaxial cable 13 (shown in greater detail in FIGS. 4A-4B) through an electric field that exists between dipole assembly 12 and coaxial cable 13. For example, if dipole assembly 12 receives electrical signals, the electrical signals are transmitted to coaxial cable 13 via the electric field between dipole assembly 12 and coaxial cable 13. The electrical signals are then transmitted via coaxial cable 13 to radio connector 16, such that the electrical signals can be broadcasted through an external radio. Conversely, if dipole assembly 12 transmits electrical signals, dipole assembly 12 receives the signals from radio connector 16 via coaxial cable 13 and the electrical field between coaxial cable 13 and dipole assembly 12. Magnetic element 14 is disposed between radio connector 16 and dipole assembly 12, such that magnetic element 14 prevents external signal noise from interfering with the electrical signals received and/or transmitted by antenna assembly 10. Antenna assembly 10 terminates in radio connector 16, which is adapted to mechanically couple with an external transmitter, such as radio 150 (depicted in FIG. 12), to either send or receive electrical signals. Each of the components will be discussed individually below.

Figure 3A:
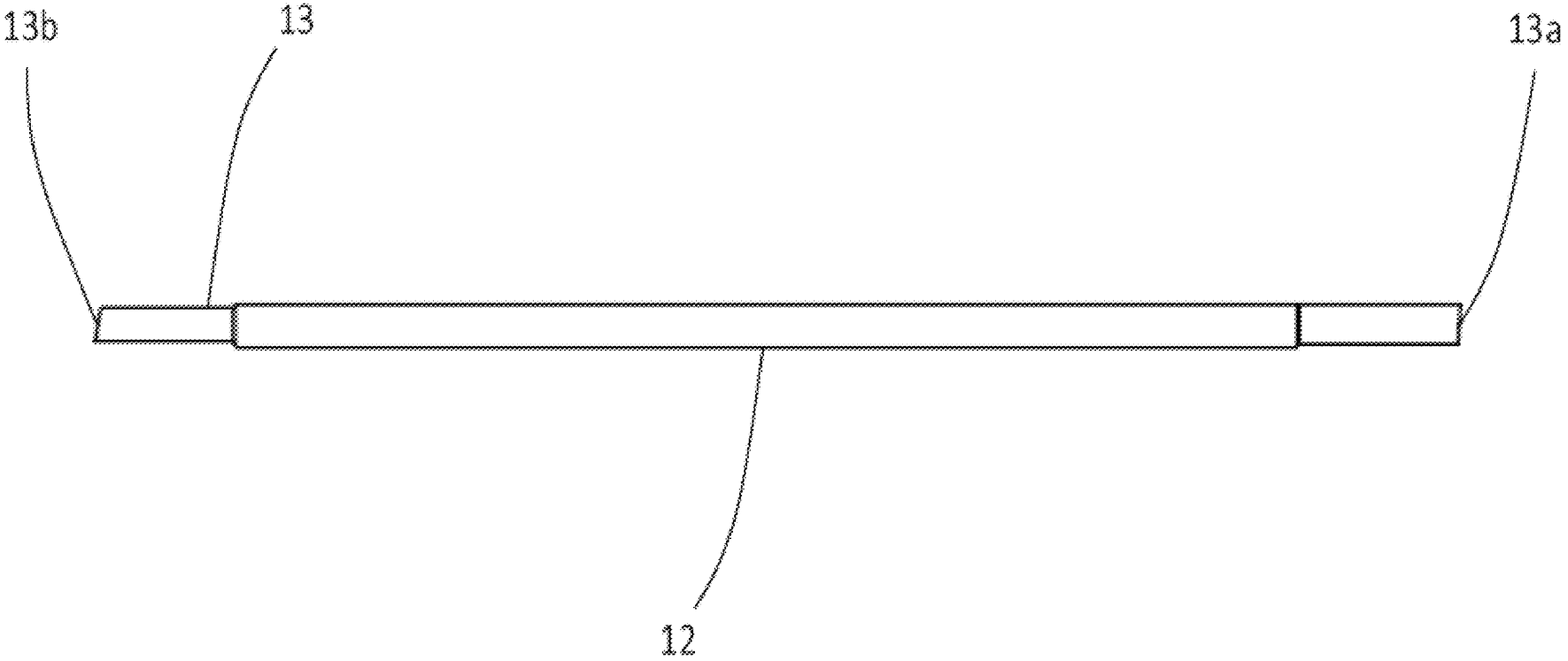
FIG. 3A illustrates a close-up orthogonal view of a radiating element of the flexible broadband antenna assembly of FIG. 2, in accordance with one or more embodiments.
Figure 3B:
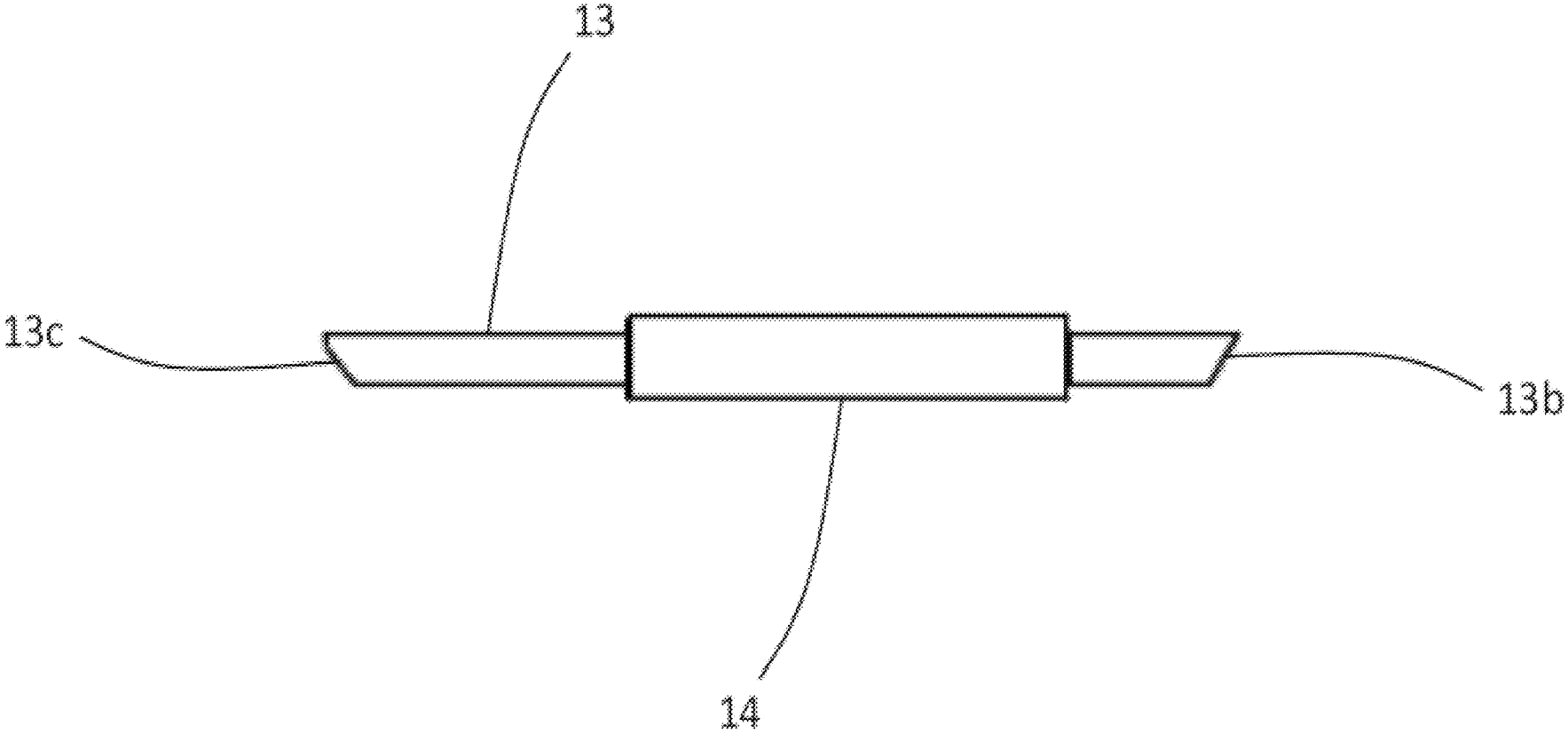
FIG. 3B illustrates a close-up orthogonal view of a magnetic component of the flexible broadband antenna assembly of FIG. 2, in accordance with one or more embodiments.
Figure 3C:
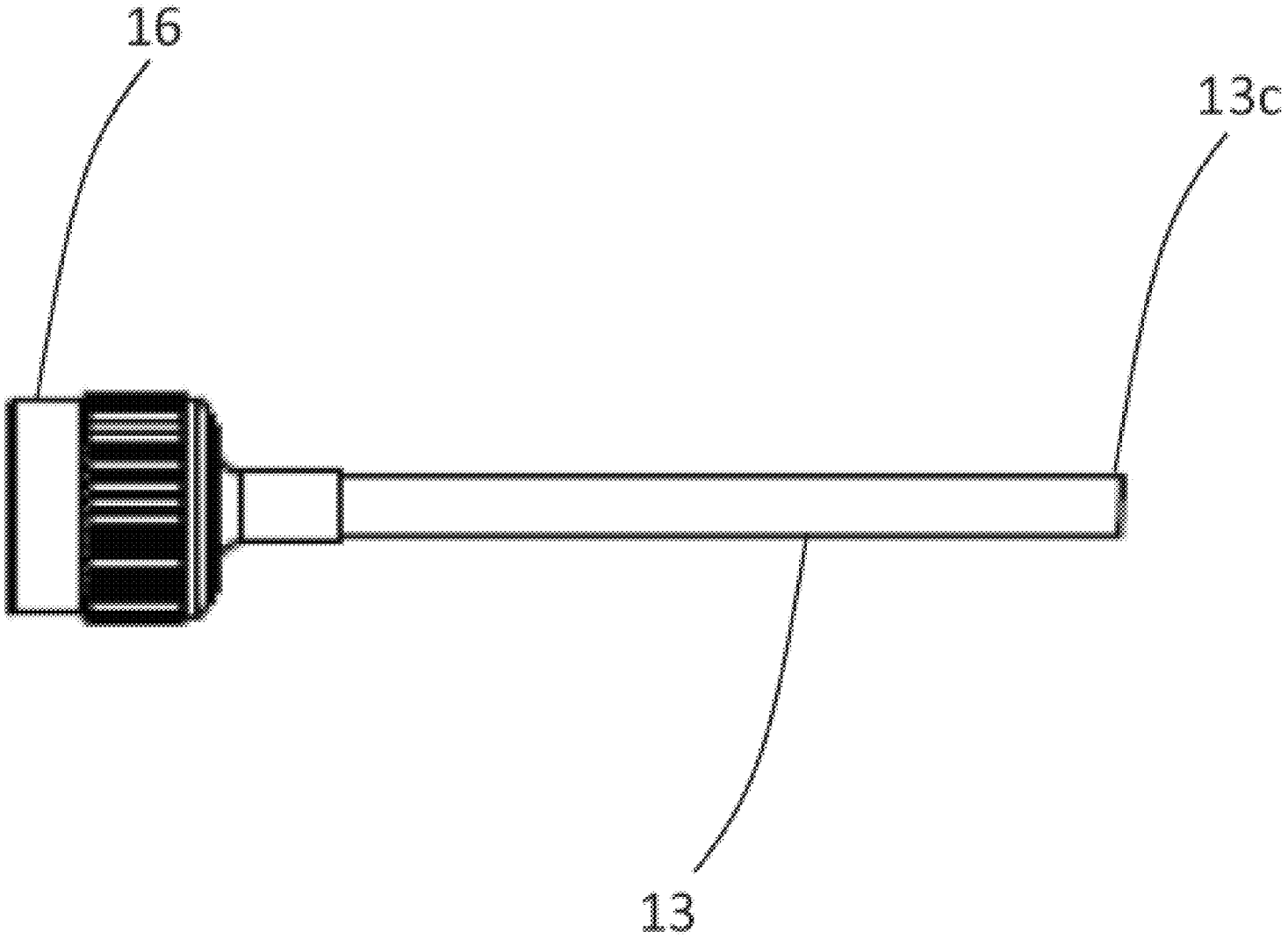
FIG. 3C illustrates an orthogonal view of a radio frequency (RF) connector of the flexible broadband antenna assembly of FIG. 2, in accordance with one or more embodiments.

FIGS. 3A-3C depict close-up views of the components of FIG. 2. For example, FIG. 3A depicts an exterior surface of dipole assembly 12, which is electrically coupled to coaxial cable 13 at sides 13*a*, 13*b*. Magnetic element 14 is shown in FIG. 3B coupled to sides 13*b*, 13*c* of coaxial cable 13, and in electrical communication with dipole assembly 12 via side 13*b* of coaxial cable 13. FIG. 3C shows radio connector 16, which is electrically coupled to magnetic element 14 and in turn dipole assembly 12 via side 13*c* of coaxial cable 13. FIG. 3C shows that radio connector 16 is a terminal coupling portion of antenna assembly 10, thereby providing a mechanism through which antenna assembly 10 can be connected to radio 150, which is adapted to communicate signals and to allow signals to be transmitted or received by antenna assembly 10.

Figure 4A:
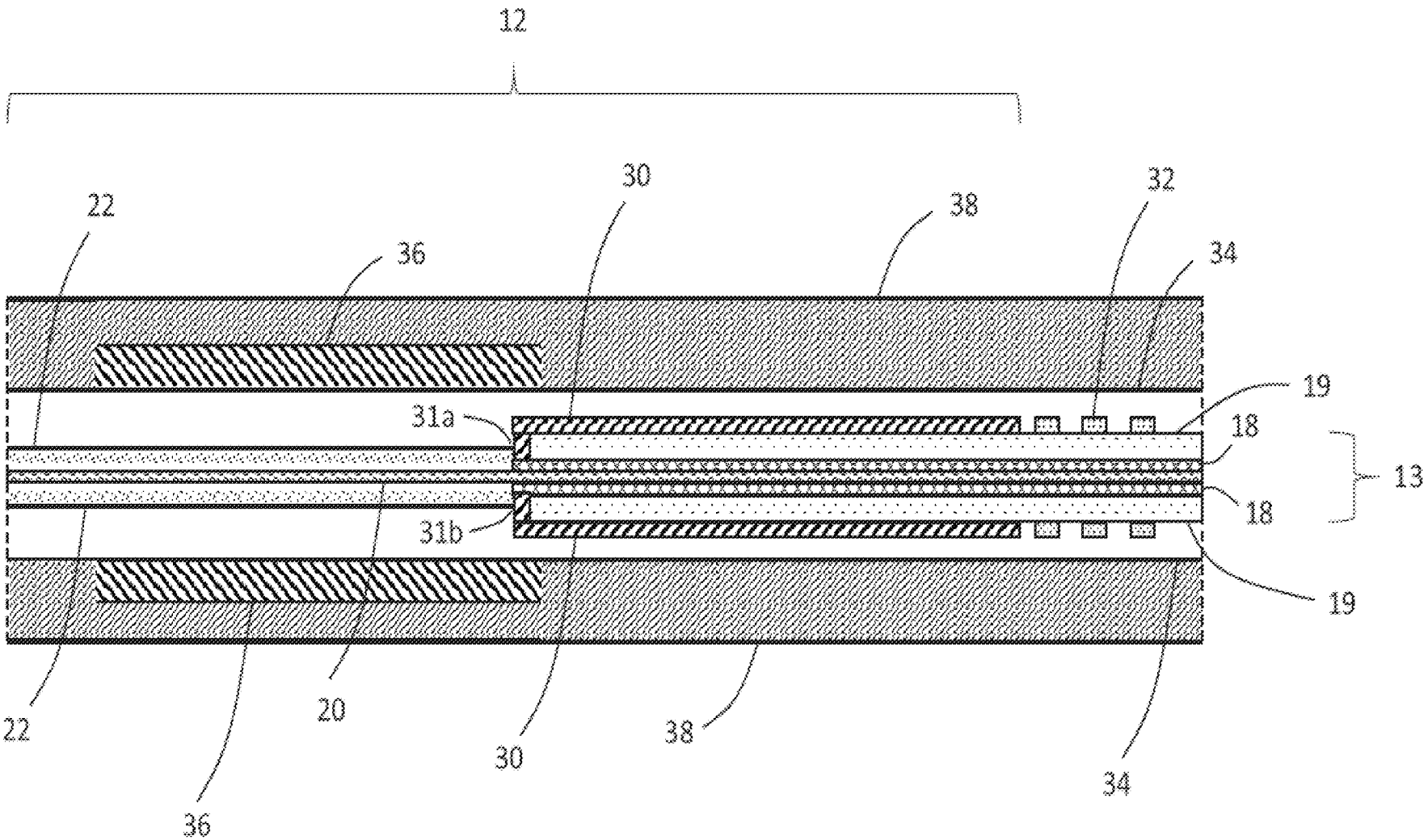
FIG. 4A illustrates a cross-section orthogonal view of the interior components of the flexible broadband antenna assembly of FIG. 2, particularly the radiating element depicted in FIG. 3A, in accordance with one or more embodiments.
Figure 4B:
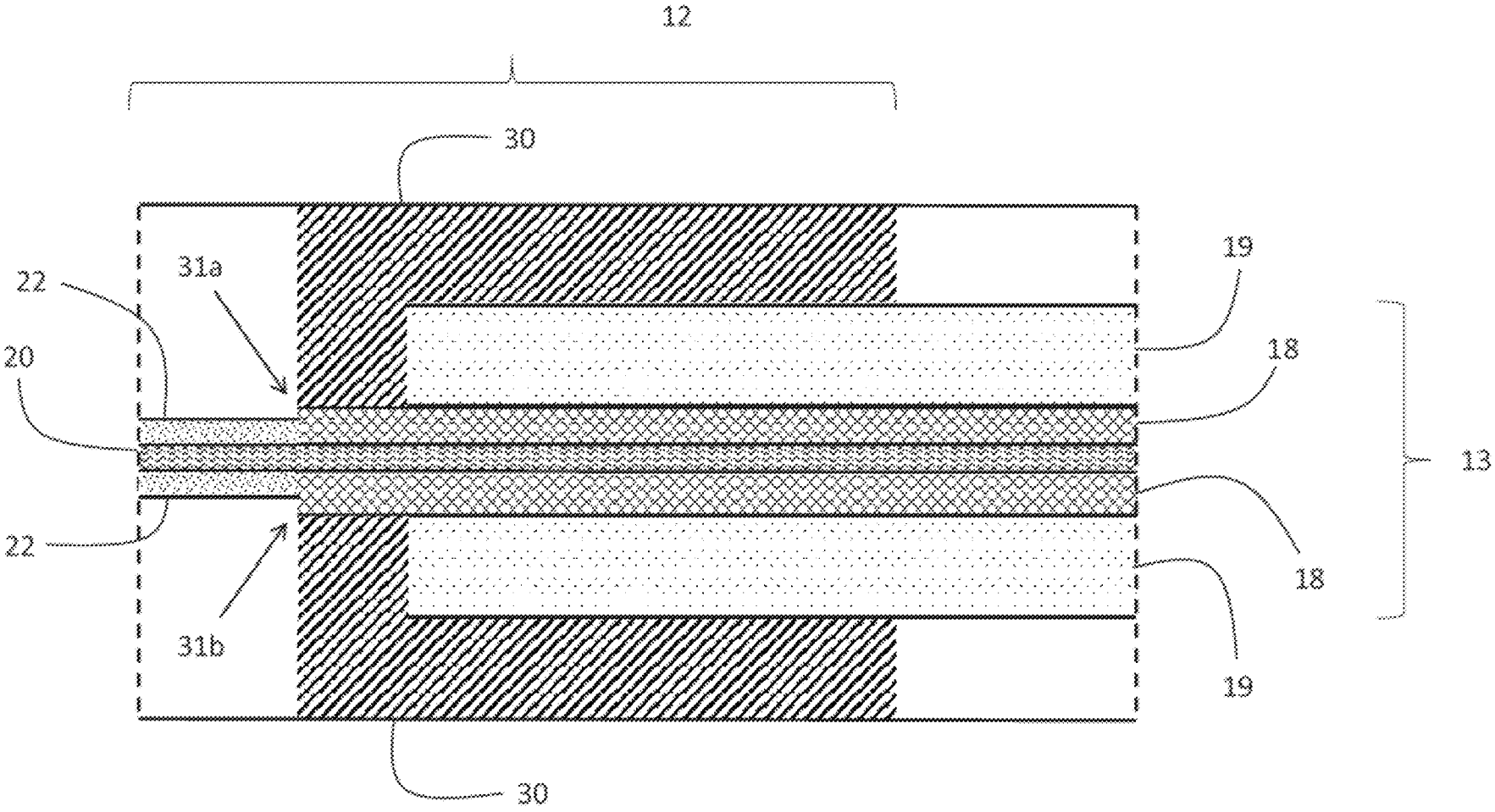
FIG. 4B illustrates a close-up cross-section orthogonal view of the interior components of the flexible broadband antenna assembly of FIG. 4A, particularly showing the connection between the lower limit radiating element and the inner shield of the coaxial cable, in accordance with one or more embodiments.

FIGS. 4A and 4B depict the internal components of dipole assembly 12, as well as the connection between dipole assembly 12 and coaxial cable 13, in greater detail. Dipole assembly 12 has a greater diameter than that of coaxial cable 13. Dipole assembly 12 is comprised of alternating conducting and insulating layers (i.e., insulating layers 22, 34 and outer jacket 38 are insulating layers; internal conductor 20, lower frequency radiating element 30, and higher frequency radiating element 36 are conducting layers), allowing dipole assembly 12 to function as the main antenna of antenna assembly 10 while surrounding coaxial cable 13. Typical coaxial cables include at least an outer jacket 19, a shield 18, and an internal conductor 20—as shown in FIGS. 4A-4B, internal conductor 20 has a diameter less than outer jacket 19 of coaxial cable 13. In the embodiment of FIG. 4A, internal conductor 20 extends away from coaxial cable 13, which has been altered to accommodate for dipole assembly 12. Internal conductor 20 is surrounded by insulation layer 22, which may be a heat shrink material that is designed to wrap around internal conductor 20 upon being subjected to high temperatures.

Outer jacket 19 of coaxial cable 13 is at least partially encased within lower frequency radiating element 30, which may be a metallic sheath or braid, such as a copper sheath or braid. A diameter of lower frequency radiating element 30 is greater than that of outer jacket 19 of coaxial cable 13, thereby allowing lower frequency radiating element 30 to surround and encase at least a portion of coaxial cable 13. Lower frequency radiating element 30 is largely cylindrical in shape, having one open end, allowing the radiating element to slide over coaxial cable 13. The opposite end of lower frequency radiating element 30 electrically couples with shield 18 of coaxial cable 13 via contacts 31*a* and 31*b*. Contacts 31*a*, 31*b* may be formed via common methods of forming an electrical connection, such as via soldering the radiating element to the shield. Contacts 31*a*, 31*b* allow the transfer of energy from coaxial cable 13 to lower frequency radiating element 30, and vice versa. As such, lower frequency radiating element 30 encases coaxial cable 13 while allowing electrical signals to travel along internal conductor 20.

Lower frequency radiating element 30 functions as the main antenna of dipole assembly 12. To bring in high-quality broadband signals, lower frequency radiating element 30 forms a dipole having a length between about ¼ and ½ of a wavelength of a lower limit operating frequency, and preferably forms a dipole having a length of ⅖ of the wavelength of the lower limit frequency to produce the largest bandwidth. The length of the dipole may vary depending on the desired frequencies of a particular application, but can be found using the formula:

$$l=\tfrac{2}{5}\lambda,$$

where l represents the length of the dipole, and λ represents the desired wavelength as determined by the formula:

$$\lambda=c/f,$$

where c/f is the ratio of the speed of light to the desired frequency, the frequency being the lower limit operating frequency that will yield the longest wavelength and, thereby, the longest dipole length. For example, if the lower limit operating frequency is 50 MHz, the dipole length is 2.4 m, following the above formula. Similarly, if the lower limit operating frequency is 1000 MHz, the dipole length is 0.12 m. As such, depending on the desired lower limit operating frequency, antennas of varying lengths can be used based on the length of the dipole needed to transmit at the lower frequency.

As shown in FIG. 4A, one or more frequency chokes 32 at least partially surround outer jacket 19 of coaxial cable 13. Frequency chokes 32, similar to lower frequency radiating element 30, have a diameter greater than that of coaxial cable 13, allowing frequency chokes 32 to partially encase coaxial cable 13. Frequency chokes 32 function as electronic chokes to prevent interfering current from flowing along coaxial cable 13 to dipole assembly 12, thereby preventing signal interference. In a preferred embodiment, three or more frequency chokes 32 are used, as shown in FIG. 4A, and frequency chokes 32 are common-mode chokes in order to suppress common mode electromagnetic signals, as well as radio frequency signals. By reducing electromagnetic and radio frequency interferences, frequency chokes 32 function to reduce signal noise. Frequency chokes 32 may be made of a variety of materials commonly used within the art, but in a preferred embodiment, frequency chokes 32 are ferrites, such as nickel zinc ferrites, having about 125 relative permeability. Relative permeability dictates the ability of a material to form a magnetic field, which thereby prevents interference from other magnetic fields. Using ferrites having relative permeability of about 125 allows antenna assembly 10 to be used to transmit and receive signals, including very-high frequency (VHF) (e.g., between 30 MHz and 300 MHz) and/or ultra-high frequency (UHF) (e.g., between 300 MHz and 3 GHz) bands.

Insulation layer 34 encases coaxial cable 13, including internal conductor 20 and insulation layer 22, as well as lower frequency radiating element 30 and frequency chokes 32. As such, insulation layer 34 acts as a first insulating barrier between the dipole formed by lower frequency radiating element 30 and subsequent electromagnetic components of antenna assembly 10. Insulation layer 34 may be PVC, or may be a heat shrink material designed to conform to the shape of the aforementioned components, providing a singular and flexible cable including an antenna.

Still referring to FIG. 4A, higher frequency radiating element 36 partially surrounds insulation layer 34. Higher frequency radiating element 36 is a second dipole sheath. Similar to lower frequency radiating element 30, higher frequency radiating element 36 may be a metallic sheath or braid, such as a copper sheath or braid. Whereas lower frequency radiating element 30 forms the dipole for the lower limit operating frequency, higher frequency radiating element 36 forms the dipole for the upper limit operating frequency. As such, higher frequency radiating element 36 has a length that is approximately 30% shorter than that of lower frequency radiating element 30, allowing higher frequency radiating element 36 to capture higher frequencies than lower frequency radiating element 30. While it is appreciated that the 30% shorter length of higher frequency radiating element 36 was found to produce the optimal bandwidth range within antenna assembly 10, it is appreciated that the ratio between the lengths of higher frequency radiating element 36 and lower frequency radiating element 30 could be greater than or less than 30%. Similar to lower frequency radiating element 30 discussed above, higher frequency radiating element 36 is cylindrical in shape, having two opposing open ends, thereby allowing higher frequency radiating element 36 to encase insulation layer 34 without interfering with lower frequency radiating element 30.

Outer jacket 38 encases all of the internal components of dipole assembly 12, including coaxial cable 13, lower frequency radiating element 30, higher frequency radiating element 36, frequency chokes 32, and insulation layers 22 and 34. Outer jacket 38 is made of similar materials as insulation layers 22 and 34, as well as outer jacket 19 of coaxial cable 13. For example, outer jacket 38 may be made of PVC, or may be made of a heat shrink material. The purpose of outer jacket 38 is to provide an outer casing for the internal components of dipole assembly 12, as well as antenna assembly 10, allowing dipole assembly 12 to be flexible as well as insulated from exterior signals, and antenna assembly 10 to be largely noise-free when transmitting or broadcasting electrical signals. The flexibility of outer jacket 38, as well as the internal components of dipole assembly 12, allows antenna assembly 10 to be transported for remote applications without the need for bulky and rigid equipment, such as rigid external antennas.

Figure 5:
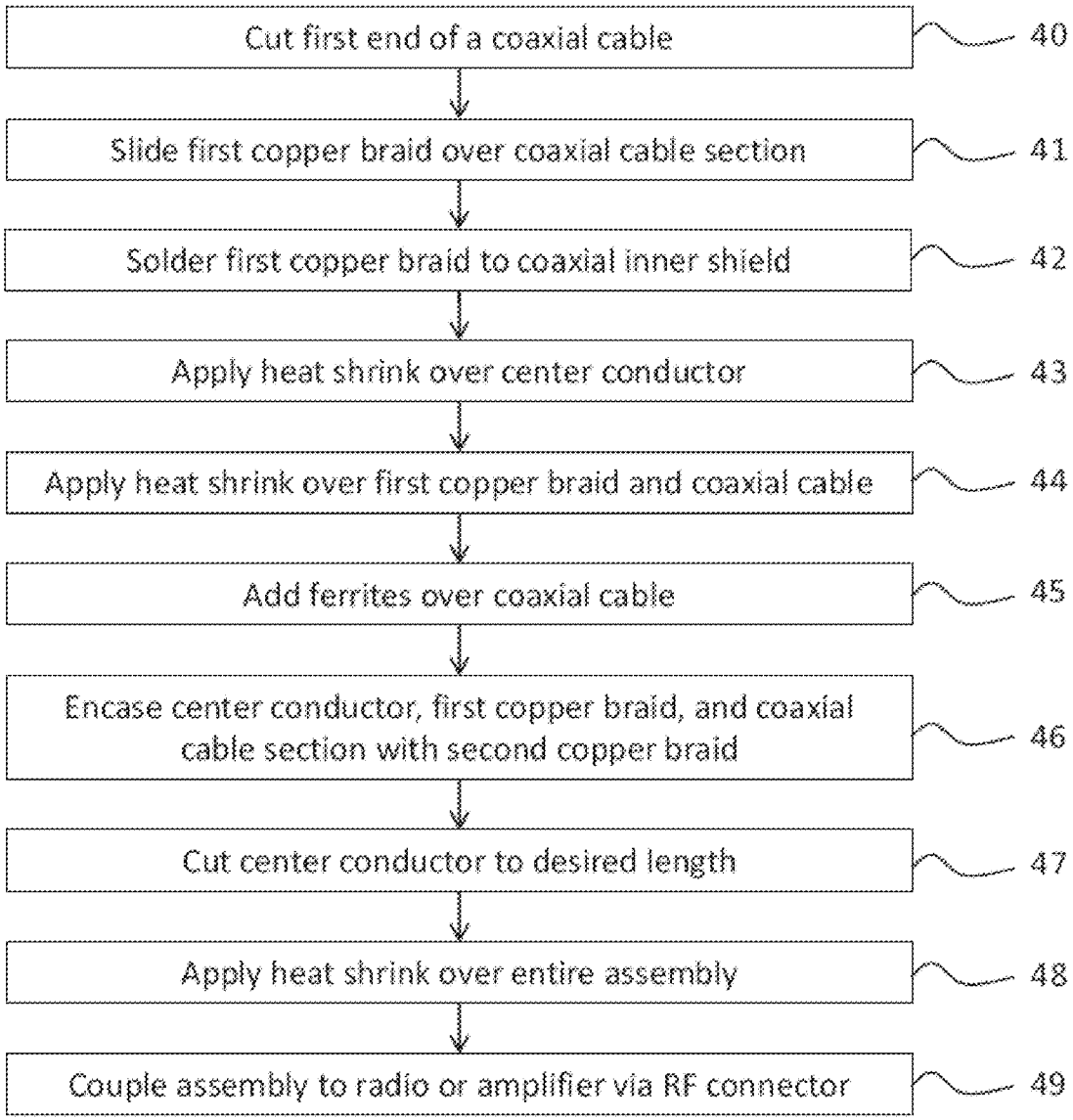
FIG. 5 illustrates a process flow diagram of a method of manufacturing a flexible broadband antenna assembly, in accordance with one or more embodiments.

Antenna assembly 10 can be formed together with coaxial cable 13, or can be retrofit onto an existing coaxial cable 13 through a series of steps. Regardless of the method of manufacture, the process of forming a dipole antenna, such as antenna assembly 10, is largely identical. Accordingly, referring now to FIG. 5, in conjunction with FIGS. 1-4B, an exemplary process-flow diagram is provided, depicting a method of forming a dipole antenna assembly. The steps delineated in the exemplary process-flow diagram of FIG. 5 are merely exemplary of a preferred order of forming a dipole antenna assembly. The steps may be carried out in another order, with or without additional steps included therein.

First, during step 40, outer jacket 19 of coaxial cable 13 is cut to expose the metallic sheath immediately underneath. The cut is made such that the length of the metallic sheath that is exposed measures approximately ⅕ of a wavelength of a lower limit operating frequency. The exposed length of metallic sheath is then removed from coaxial cable 13, and a new lower frequency radiating element 30 is cut to be the same length as the removed, exposed metallic sheath from the original coaxial cable 13. While the removed metallic sheath was housed within coaxial cable 13, thereby inherently having a diameter smaller than that of coaxial cable 13, new lower frequency radiating element 30 has a diameter slightly greater than that of coaxial cable 13. The difference in diameters allows lower frequency radiating element 30 to at least partially surround coaxial cable 13, and lower frequency radiating element 30 may be slid over coaxial cable 13 in step 41, as depicted in FIG. 4A. Lower frequency radiating element 30 couples with shield 18 on coaxial cable 13 in step 42, during which the radiating element is soldered to shield 18, thereby providing for the transfer of energy between coaxial cable 13 and lower frequency radiating element 30.

The removal of the metallic sheath of coaxial cable 13 exposes internal conductor 20, which could cause interference and/or a short circuit between internal conductor 20 and lower frequency radiating element 30. As such, it is important to insulate internal conductor 20 during step 43, thereby providing insulation layer 22 between internal conductor 20 and lower frequency radiating element 30. Insulation layer 22 may be formed via a heat shrink material, such as by wrapping internal conductor 20 in a heat shrink material, and subsequently exposing the heat shrink material to a high temperature. The high temperature reduces the diameter of the insulation layer 22, until insulation layer 22 conforms to the shape of internal conductor 20. Similarly, during step 44, coaxial cable 13 and lower frequency radiating element 30 are encased within insulation layer 34.

To reduce signal interference from common mode electrical currents, which could distort the antennas radiation pattern, a plurality of frequency chokes 32 are installed over coaxial cable 13 during step 45. In a preferred embodiment, and as shown in FIG. 4A, at least three frequency chokes 32 are used. Frequency chokes 32 are preferably ferrites, such as nickel zinc ferrites. After installing frequency chokes 32 on coaxial cable 13 and upstream from lower frequency radiating element 30, which is the main antenna of antenna assembly 10, the internal components are encased in another insulation layer 34.

During step 46, the insulated coaxial cable 13 and dipole assembly 12 are then further partially encased in higher frequency radiating element 36, which is similar to lower frequency radiating element 30, except in length—higher frequency radiating element 36 is shorter than lower frequency radiating element 30 by approximately 30%. Insulation layer 34 provides a barrier between the most interior components of dipole assembly 12 and higher frequency radiating element 36, thereby reducing noise and preventing signal interference.

Internal conductor 20 is cut to a desired length based on the application of antenna assembly 10 during step 47. In step 48, once the desired length is selected, outer jacket 38 encases the internal components of antenna assembly 10, including higher frequency radiating element 36, as well as the components housed within insulation layer 34 but not encased by higher frequency radiating element 36. Outer jacket 38, as well as insulation layers 34 and 22, is made of a flexible material, such as PVC or heat shrink material, allowing the entirety of antenna assembly 10 to be flexible and easily transported for mobile uses. Finally, during step 49, antenna assembly 10 electrically couples with a radio, amplifier, or other transmitter via radio connector 16.

Figure 6:
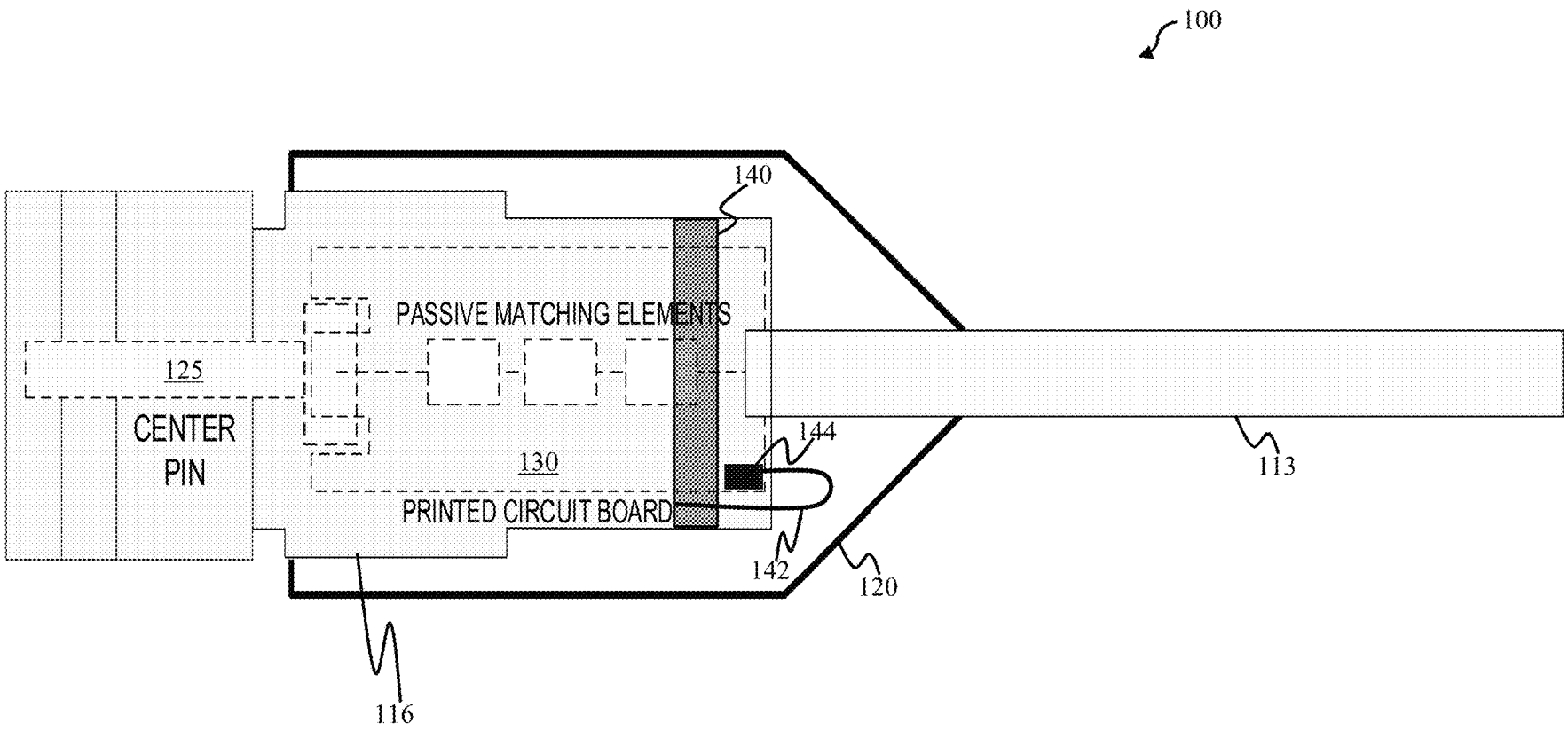
FIG. 6 illustrates an example of a flexible antenna apparatus, in accordance with one or more embodiments.

Presently disclosed are ways of making and using a flexible, base-loaded antenna. For example, the present disclosure describes a construction method of the antenna, and typical methods for wearing the antenna on the body. As shown in FIG. 6, some embodiments of antenna assembly 100 include the following components: flexible radiating element section, RF connector 116, RF matching assembly 130, and over-molding assembly 120. In some embodiments, RF matching assembly 130 may be a PCB that has passive components 132 coupled to it. The flexible radiating element section may include flexible conductor 113 and one or more of a non-conductive jacket, one or more central (e.g., axial) conductors, and one or more insulating layers. Some embodiments of antenna assembly 100 may eliminate need for adapter(s) between flexible conductor 113 and radio 150 (or an associated amplifier), e.g., by integrating antenna components into a coaxial cable and a connector for that cable.

In some embodiments, the flexible radiating element section (e.g., flexible conductor 113) may be used to form a monopole or dipole antenna. In some embodiments, dipole assembly 12 may be coupled to connector 116 and printed circuit board (PCB) 130. That is, a matching network on PCB 130 may be used for matching impedance of a dipole antenna and/or of a monopole antenna.

As compared to dipole antennas, which have positive and negative halves inherently created in the antenna structure, monopole antennas only have a positive half as physical structure. That is, with monopole antennas, the body of the radio (i.e., the conductive chassis) acts as the negative half or as the other half of a dipole. As such, for a given length of antenna, monopole antennas provide twice the radiating length than dipole antennas. Some embodiments of antenna assembly 100 may thus comprise monopole antenna 113 to improve upon configurations that use dipole antennas by supporting a wider bandwidth (i.e., frequency coverage). Whereas dipole assembly 12 of antenna assembly 10 may at best support one or two octaves, monopole antenna 113 may be used to support multiple octaves (e.g., four or more).

FIG. 6 illustrates antenna assembly 100, including a multi-band monopole antenna that uses flexible material (e.g., a wire, pole, or copper-braid of a coaxial cable). In some embodiments, flexible conductor 113 may be made of a metallic (e.g., copper) braid. But flexible conductor 113 may be made of any suitable, flexible, and rugged material, e.g., which has a considerable amount of surface area. This flexible material may be combined with a passive RF matching network integrated into RF connector assembly 116.

Figure 7:
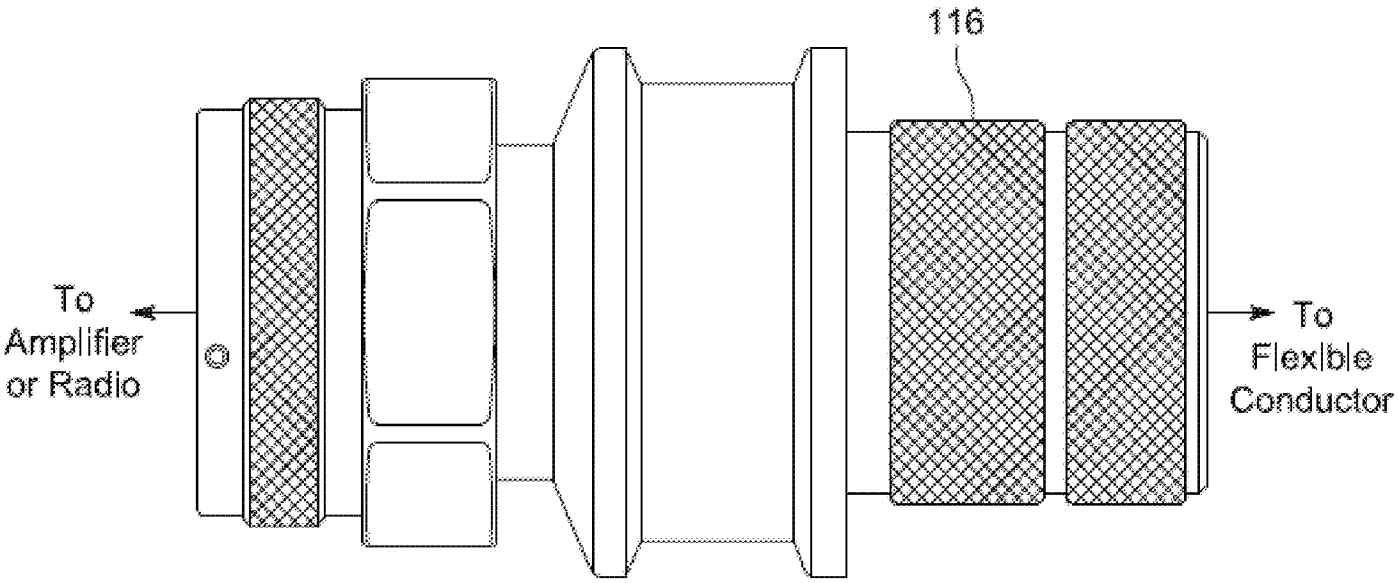
FIG. 7 illustrates an RF connector used with the flexible antenna apparatus, in accordance with one or more embodiments.

FIG. 7 depicts one example of connector 116. In this example, connector 116 may couple to a coaxial cable. One end of connector 116 may be coupled to flexible conductor 113, and the other end of connector 116 may be coupled to radio 150 or its associated amplifier. RF connector 116 may be of any suitable type (e.g., N, SMA, TNC, BNC, etc.). In some embodiments, RF connector 116 may be a commercial off the shelf (COTS) connector. In some implementations, the connector may have enough space within its shell to house passive, electrical components for at least impedance matching purposes.

Figure 8:
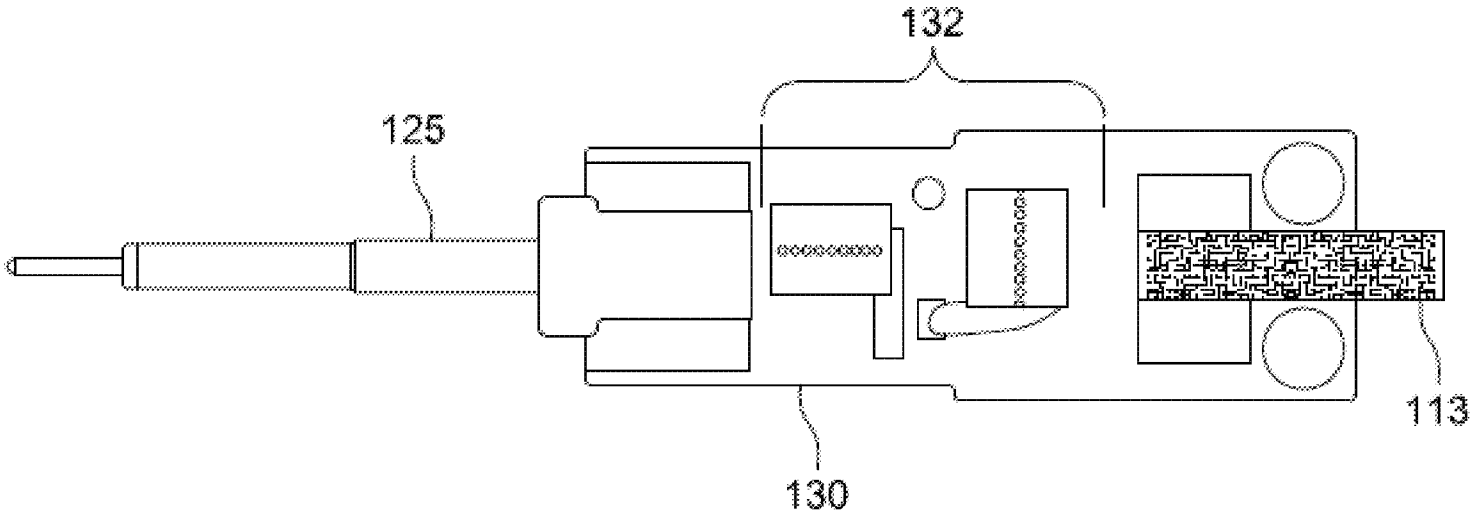
FIG. 8 illustrates an impedance matching PCB that may be integrated into the RF connector and that may interface with a center pin and radiating element, in accordance with one or more embodiments.

FIG. 8 depicts PCB 130, including its matching network. One end of PCB 130 may be fixedly coupled to flexible conductor 113, and another end of PCB 130 may be fixedly coupled to center pin 125. In implementations where flexible conductor 113 is a coaxial cable, the braid of the coaxial cable may be soldered to the matching network, since the braid may act as a radiating element. In these implementations, the central conductor of the coaxial cable may be floating (i.e., it may not be attached to anything). In some embodiments, another central conductor (e.g., pin) of a connector may be directly soldered to PCB 130. Some exemplary embodiments may have a minimized distance between that central conductor (pin) and PCB 130. For example, this PCB may have been machined such that a portion is notched out for directly coupling PCB 130 to the central conductor. The PCB may thus have a cutout for coupling a center pin thereto. For example, a proximal end of center pin 125 may be configured to mate with PCB 130, via a slot of a corresponding cutout along an edge of the PCB.

In some embodiments, RF connector 116 may be a male connector. In other embodiments, this connector may have a female configuration.

In some embodiments, antenna 100 may be configured to transmit and/or receive radio waves in all horizontal directions (i.e., as an omnidirectional antenna such that a 360 degree radiation performance may be achieved) or in a particular direction (i.e., as a directional, "beam" antenna). In some implementations, antenna 100 may include one or more components, which serves to direct the radio waves into a beam or other desired radiation pattern.

In some embodiments, PCB 130 may comprise a matching network (e.g., an RF matching network formed using passive, lumped components 132) and include components, such as inductors, coupled inductors, resistors, capacitors, transmission lines, etc., to match the impedance of flexible conductor 113 to the impedance of a terminating radio (e.g., radio 150) or associated amplifier. This matching network's components may be provided as discrete components (e.g., via surface-mount and/or through-hole mount).

Figure 9:
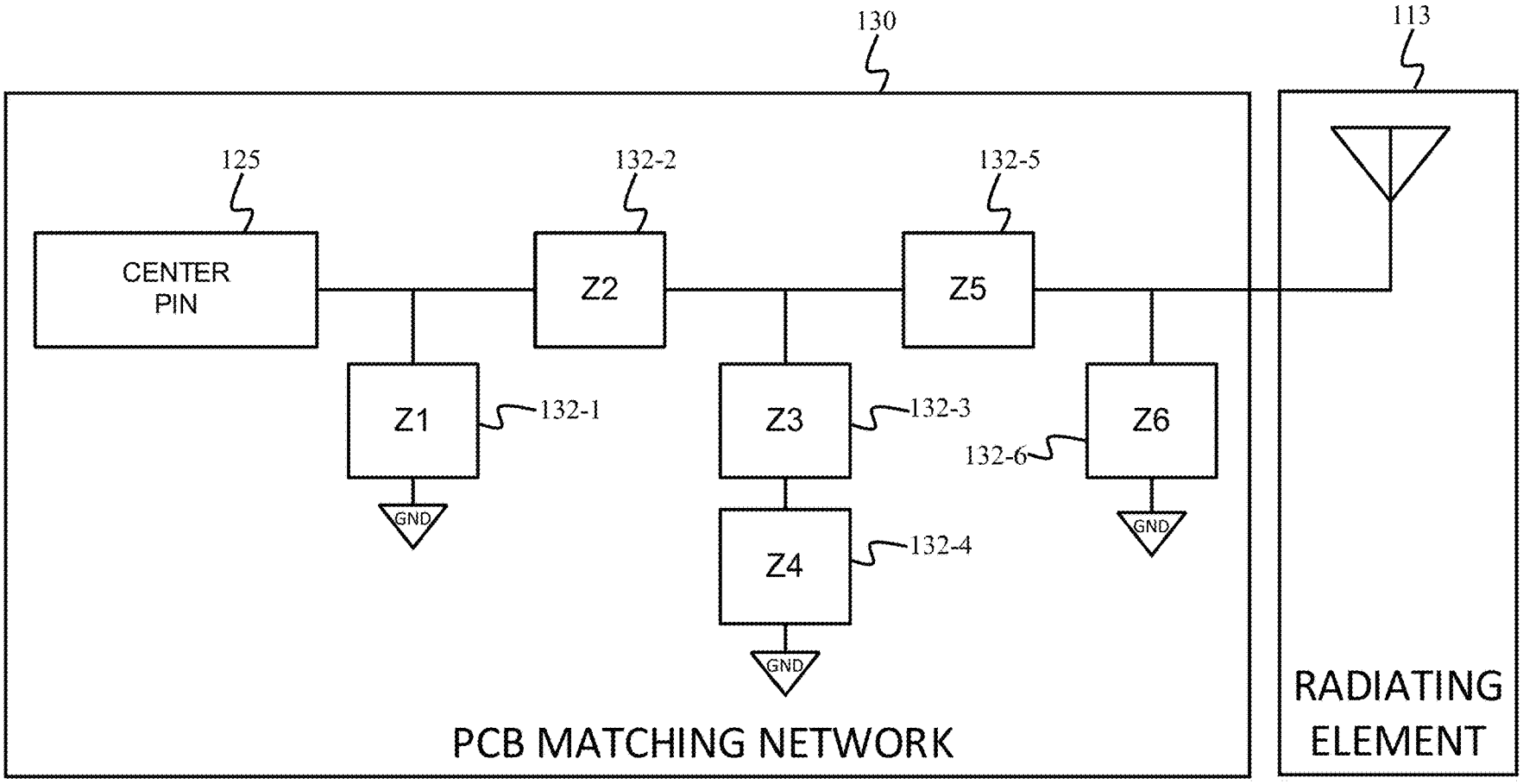
FIG. 9 illustrates the impedance matching PCB and the radiating element, in accordance with one or more embodiments.

FIG. 9 depicts a set of passive components 132 (e.g., 132-1, 132-2, 132-3, 132-4, 132-5, and/or 132-6), which may include resistors, capacitors, and/or inductors. In some embodiments, a particular configuration (e.g., shunt, series, etc.) and the values of these passive components that comprise the matching network may be determined based on minimizing the network's insertion loss, maximizing the bandwidth of the network, minimizing voltage standing wave ratio (VSWR), and/or other performance characteristics. In some implementations, each of passive components 132 may be a different component and/or have a different value. For example, 132-1 may be a resistor, while 132-2 may be a capacitor or inductor. The matching network of PCB 130 may be implemented as a resistive network. In other implementations, the matching network of PCB 130 may be implemented as a transformer, stepped transmission line, filter, L-section (e.g., capacitor and inductor), or another set of components. Also depicted in FIG. 9 are center pin 125 and flexible conductor 113, which may be soldered to opposite ends of PCB 130. Center pin 125 may be used to mate with another RF connector.

In some embodiments, the matching network of PCB 130 may be traversed reciprocally, e.g., where the transmit and receive paths of communication signals use the same set of passive component values. In some embodiments, the matching network of PCB 130 is designed such that it does not absorb any power for one or more pass-bands, the matching network being substantially lossless within the pass-band(s).

As mentioned, FIG. 9 depicts some details of PCB 130, including passive components 132 (each of which may have a unique value), a connection to center pin 125, and an interface to radiating element 113. In some embodiments, one or more component values of the matching network may be adjusted to accommodate a chosen length of flexible conductor 113. That is, flexible conductor 113 may initially be cut to a desired length. Flexible conductor 113 may be made from a piece of flexible, copper-braided material that has an outer, non-conductive jacket.

An outer, non-conductive jacket may be configured to enclose flexible conductor 113. The non-conductive jacket may be similar to outer jacket 19 and/or outer jacket 38. This jacket may be cut back at one end of flexible conductor 113 to permit soldering. Next, PCB 130 may comprise an RF matching network soldered to a portion of flexible conductor 113 and to center pin 125 of RF connector 116. The matching network may include passive, matching components 132, such as resistors, capacitors, and inductors. Then, flexible conductor 113 and PCB 130 may be slid or otherwise inserted into connector 116. After this insertion, connector 116 may be filled with a non-conductive compound, such as epoxy or a potting compound. The epoxy and/or potting compound may fixedly couple PCB 130 to connector 116 such that heat may be transferred from passive components 132 to a shell of connector 116. Once the inside of connector 116 has dried, at least portions of this connector and radiating element 113 may be over-molded using an over mold compound or another suitable material (e.g., plastic). Over-molding 120 may be formed of a different material, and it may provide strain relief for the flexible, radiating element to prevent premature damage.

In some embodiments, PCB 130 may further comprise electrical connection 144 (e.g., solder), metallic band 140, and metallic (e.g., copper) braid portion 142, as depicted in FIG. 6. For example, copper braid portion 142, which may form part of the flexible radiating element section, may be soldered to the ground of PCB 130. In some implementations, the braid (e.g., portion 142 and/or a portion of braid 113) may then be compressed to the shell of connector 116 with band 140. For example, a grounding strap or copper braid may be used to solder or otherwise electrically connect the ground of PCB 130 to the outside shell of connector 116. In this example, the strap or braid may then be clamped to connector 116 via metallic band 140. The ground strap/braid and band may help conduct heat from the internal components of PCB 130 to the shell of connector 116.

Matching networks are typically connected between a source and load, and its circuitry is usually designed such that it transfers almost all power to the load while presenting an input impedance that is equal to the complex conjugate of the source's output impedance. Alternatively, a matching network transforms the output impedance of the source such that it is equal to the complex conjugate of the load impedance. In some implementations, the source impedance has no imaginary part, and thus reference to the complex conjugate may not be applicable. Therefore, the load impedance may be equal the source impedance because the complex conjugate is not relevant when the impedance is purely real.

In some embodiments, the matching network of PCB 130 may use only reactive components, i.e., components that store energy rather than dissipate energy. But this is not intended to be limiting, as each application or scenario may require a different matching network (e.g., due to the different operating frequencies).

Figure 10:
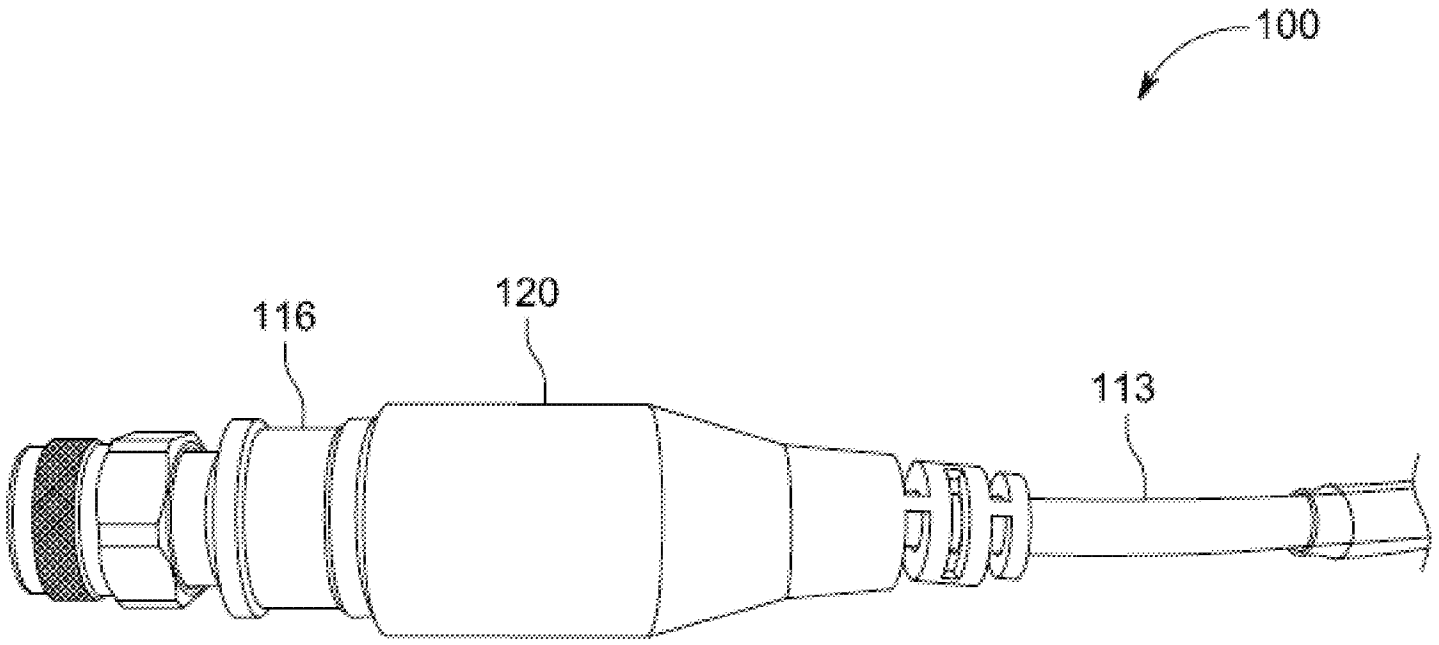
FIG. 10 illustrates an over-molding for the flexible antenna apparatus, in accordance with one or more embodiments.

FIG. 10 exemplarily depicts antenna assembly 100, including connector 116, over-molding 120, and a portion of flexible conductor 113. In some embodiments, over-molding 120 may be used to protect passive components 132, e.g., against ingress of water, dust, or other elements. Passive components 132 may be fully enclosed at the base within connector 116.

In some embodiments, over-molding 120 comprises means for protecting the PCB from any ingress and means for mating flexible conductor 113 to connector 116 such that it withstands strain and/or pressure. In some implementations, an amount of over-molding 120 may be as small as possible such that the over-molding reliably fulfills its function(s) (e.g., protection from elements, support against tension or other manipulation during manufacture or field use, or another suitable function). In some embodiments, over-molding 120 is injection molded, but the molding process is not intended to be limiting as any suitable approach may be used.

Some embodiments may have, within shells of connectors 116, some epoxy and/or potting compound to provide a suitable degree of strain relief, as with over-molding 120. For example, a suitable amount of the epoxy may be purposefully applied at junctures between PCB 130, connector 116, center pin 125, and/or flexible conductor 113, without that applied amount being so great that a quality of the communication is disrupted by there being epoxy adjacent to a component of PCB 130.

Figure 11:
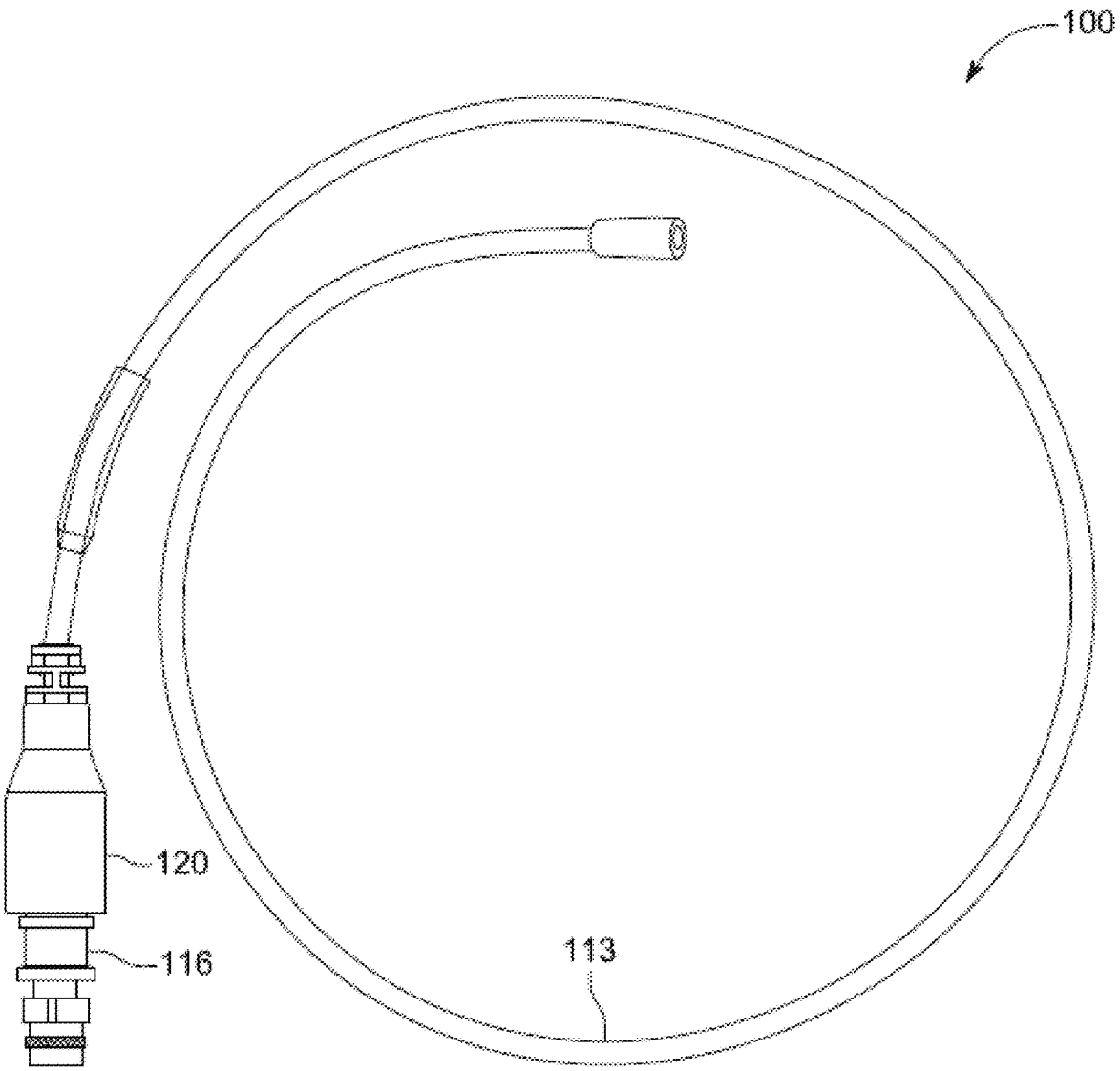
FIG. 11 illustrates a full-length antenna apparatus, in accordance with one or more embodiments.

FIG. 11 depicts the same antenna assembly 100 of FIG. 10, additionally showing a full, exemplary length of flexible conductor 113. In some embodiments, flexible conductor 113 may have a length that is less-than or equal-to a fraction of the wavelength for a radio signal. For example, flexible conductor 113 may have a length of around 39 inches, which is substantially less than ¼ of a 10 meter wavelength of a 30 MHz radio signal. Some embodiments of the set of passive components 132 of PCB 130 may have received tuning (e.g., of values and positions of components) such that one or more performance characteristics satisfies a criterion.

Figure 12B:
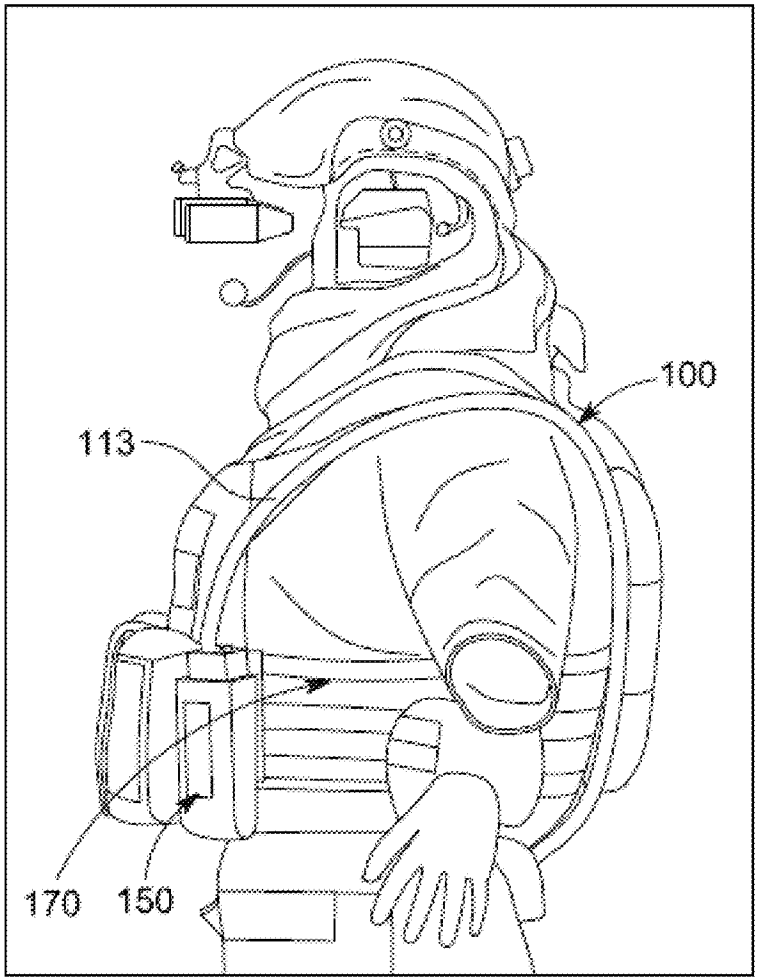
FIGS. 12A-12B illustrate a user wearing the flexible antenna apparatus, in accordance with one or more embodiments.
Figure 12A:
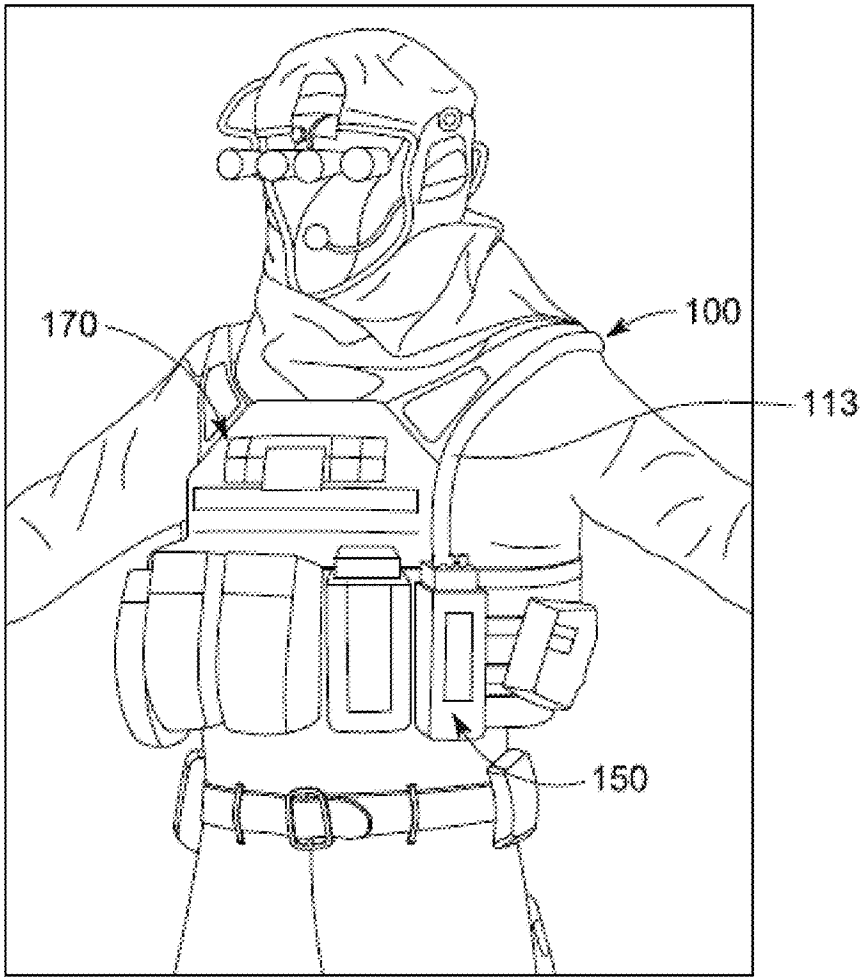

FIGS. 12A-12B depict partial-front and side-elevation views, respectively, of a user wearing an antenna assembly 100 having flexible conductor 113 by means of garment 170. Garment 170 may be used to attach antenna assembly 100 to the user and to further secure radio 150, e.g., when the radio is not in use. In some embodiments, antenna assembly 100 may be coupled via connector 116 to a mating connector of radio 150 or high power amplifier. Flexible conductor 113 of antenna assembly 100 may be looped over a body of a user, as depicted in FIG. 12, and secured to garment 170 by one or more straps, cords, buttons, or other fasteners. For example, garment 170 may unobtrusively secure flexible conductor 113, which may flexibly and/or snugly bend around a shoulder, without jutting out beyond a contour of the user.

In some embodiments, one end of flexible conductor 113 may be coupled to PCB 130 and/or connector 116, and an opposite end of flexible conductor 113 may not be coupled to anything (i.e., the opposite end may be freely positioned). In some embodiments, garment 170 may be an article of clothing, such as a vest, or an accessory worn in relation to one or more body parts of the user.

After attached to clothing or other gear of the user, radio 150 and/or an amplifier associated with the radio may transmit RF energy into antenna 100. In some embodiments, radio 150 may be any electronic device that communicates wirelessly, such as the Harris PRC-152, Harris PRC-163, Thales PRC-148 MBITR, Thales MBITR2, etc. But these examples are not intended to be limiting, as the disclosed approach may operate on any radio that has a metallic case.

In some embodiments, antenna assembly 100 may perform best when directly coupled to radio 150 and/or the amplifier. Performance in terms of gain and VSWR may be more optimal at a higher end of the antenna's frequency range due, e.g., to a less negative effect by any resistive matching of the matching network. In some implementations, how close the impedance of the antenna is to the characteristic impedance of the system may be measured by measuring the VSWR. In some implementations, the characteristic impedance will be 50 ohms, however this example is not intended to be limiting as the disclosed approach may be adapted to support any characteristic impedance. The VSWR may be a function of the magnitude of the reflection coefficient. The VSWR may provide a rough estimate of an amount of power reflected by an antenna over a specified frequency range.

In some embodiments, antenna assembly 100 may exhibit several advantages over conventional antennas. For example, the assembly's flexibility resulting from its construction using flexible material may permit an easy, wearable installation. In another example, antenna assembly 100 may be broadband in nature, e.g., covering at least 4 octaves of bandwidth with less than 3.5:1 VSWR (i.e., less than 5% 3:1 VSWR bandwidth). That is, known, flexible antennas support significantly less than 4 octaves, with an octave characterizing a band that spans at least twice a lowest frequency of that band. Further, due to the passive matching network of PCB 130, a length of radiating element 113 may be any arbitrary length. However, some implementations of this conductor may have a minimum length of $1/8^{th}$ a wavelength at the lowest operating frequency, for satisfying certain performance criteria. In some implementations, the closer the antenna is to ¼ of a wavelength at the lowest frequency of operation, the more optimal the performance.

As mentioned, FIG. 12 depicts a user (in this case, a soldier) with antenna assembly 100 mounted to garment 170 of the user. The mounting of this antenna to the user's clothing may cause better performance when flexible conductor 113 runs perpendicular to the ground, it not being preferable in some cases (e.g., when antenna assembly 100 is vertically polarized) for this conductor to run horizontal to the ground.

Figure 13:
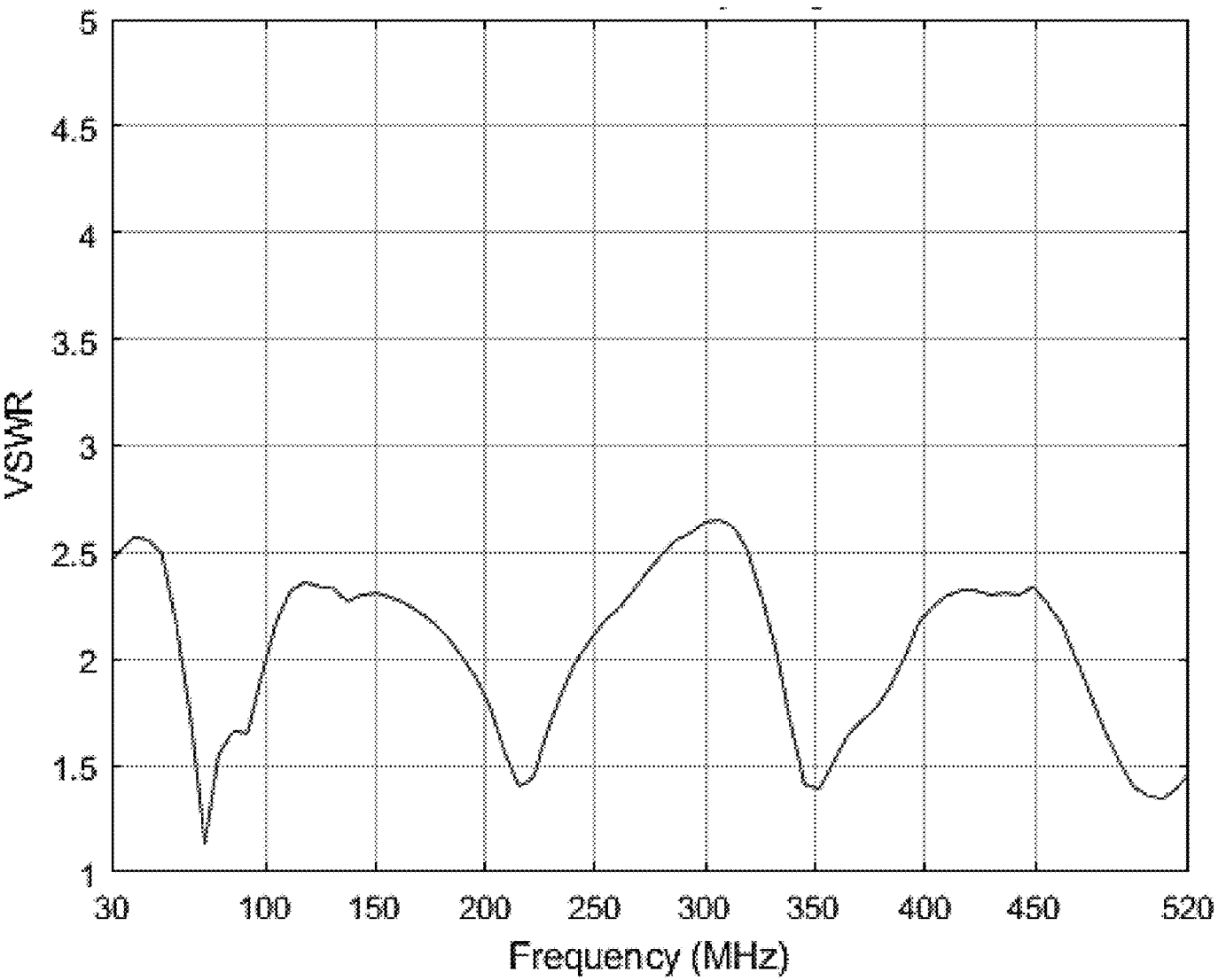
FIG. 13 illustrates performance characteristics of the flexible antenna apparatus, in accordance with one or more embodiments.

FIG. 13 depicts a plot of VSWR to operating frequency. As shown, certain frequencies may provide better performance than others. Also shown in FIG. 13 is a potentially acceptable performance level, across multiple frequency bands.

In some embodiments, antenna assembly 100 may support multiple bands of frequency, e.g., in a range between about 10 MHz and 2 GHz. More preferably, this multi-band range may be between about 30 MHz and 520 MHz to support VHF/UHF coverage. But this particular broadband support is not intended to be limiting, as any high-frequency band or any multiple bands (e.g., in KHz, MHz, or GHz range) may be supported. As such, radio 150 may be an emitter of any suitable communications frequency, e.g., to a remote receiver. In these or other embodiments, radio 150 may be a receiver of any suitable communications frequency, e.g., from a remote transmitter.

In some embodiments, antenna assembly 100 may be ultra-lightweight (e.g., to support tactical operations). For example, antenna assembly 100 may weigh as little as 2 ounces (oz); more preferably, antenna assembly 100 may weigh about 4.5 oz. An envelope of antenna assembly 100 may be streamlined to save space, prevent snags, i.e., effectively reducing over-all profile, and to decrease a visibility signature. Some exemplary embodiments of antenna assembly 100 may provide suitable performance, from a prone position of a user. Some exemplary embodiments of antenna assembly 100 may support body masking, limiting degradation of RF performance. For example, in implementations where flexible conductor 113 is looped over a shoulder of a user, this conductor may be both in front and in back of the user's body. As compared to a normal whip antenna, which is only at one side of a body, the radiation pattern of the disclosed, body-worn antenna by radiating both in-front and in-back may not experience as much of a null (i.e., due to the body blocking the signal). In some embodiments, antenna assembly 100 may support an RF capacity of about 10 Watts. In some embodiments, antenna assembly 100 may provide a gain ranging from about −25 to +10 dBi (decibel (dB) relative to isotropic). More preferably, this gain range may be between about −15 to +2 dBi.

Figure 14:
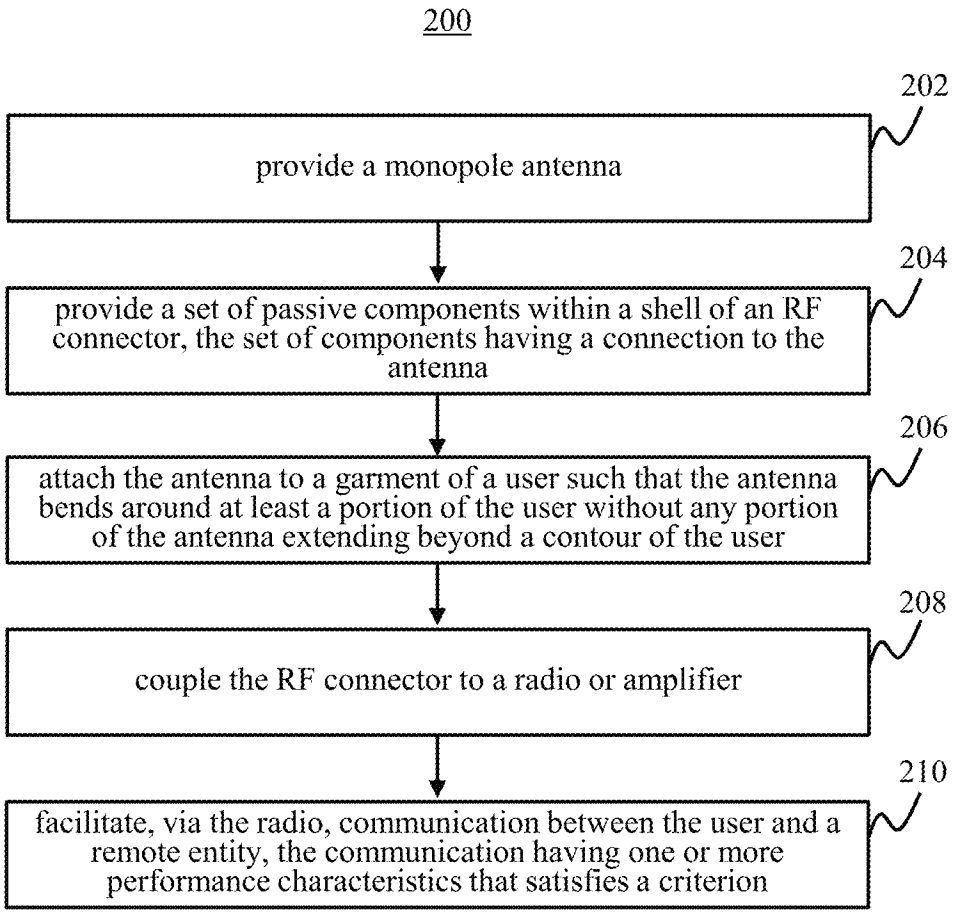
FIG. 14 illustrates process for providing a multi-band, wearable antenna, in accordance with one or more embodiments

FIG. 14 illustrates method 200 for providing a multi-band, wearable antenna, in accordance with one or more embodiments. Method 200 may be performed with radio equipment. The operations of method 200 presented below are intended to be illustrative. In some embodiments, method 200 may be accomplished with one or more additional operations not described, and/or without one or more of the operations discussed. Additionally, the order in which the operations of method 200 are illustrated in FIG. 14 and described below is not intended to be limiting.

At operation 202 of method 200, a monopole antenna may be provided. As an example, flexible conductor 113 may be cut to an appropriate length from an existing coaxial cable to then serve as an antenna. For example, a length of flexible conductor 113 may be in a range from about 20 inches to 80 inches; more preferably, the length of flexible conductor 113 may be about 37 to 42 inches long. In some embodiments, operation 202 is performed by a technician using components shown in FIGS. 6, 19, and/or 12 and described herein.

At operation 204 of method 200, a set of passive components may be provided within a shell of an RF connector, the set of components having a connection to the antenna. As an example, passive components 132 may be soldered onto PCB 130. A portion of flexible conductor 113 may be soldered to an end of PCB 130, and center pin 125 may be soldered to another end of PCB 130. In some embodiments, operation 204 is performed by a technician using components shown in FIGS. 6, 19, and/or 12 and described herein.

At operation 206 of method 200, the antenna may be attached to a garment of a user such that the antenna bends around at least a portion of the user without any portion of the antenna extending beyond a contour of the user. As an example, flexible conductor 113 may fixedly loop around at least a portion of a user without visibly protruding. In some embodiments, operation 206 is performed by a technician using components shown in FIGS. 6, 19, and/or 12 and described herein.

At operation 208 of method 200, the RF connector may be coupled to a radio or amplifier. As an example, connector 116 may be mated with another RF connector associated with the amplifier or with radio 150. In some embodiments, operation 208 is performed by a technician using components shown in FIGS. 6, 19, and/or 12 and described herein.

At operation 210 of method 200, communication between the user and a remote entity may be facilitated via the radio and antenna assembly, the communication having one or more performance characteristics that satisfies a criterion. As an example, due to function of the matching network of PCB 130, radio signals may be remotely sent between radio 150 and a radio of another user. In some embodiments, operation 210 is performed by a user using components shown in FIGS. 6, 19, and/or 12 and described herein.

Several embodiments of the invention are specifically illustrated and/or described herein. However, it will be appreciated that modifications and variations are contemplated and within the purview of the appended claims.

What is claimed is:

1. An antenna assembly, comprising:

a conductor configured to receive or emit electromagnetic radiation;

a printed circuit board (PCB) configured to match characteristic impedances; and a connector configured to (i) directly couple to another connector of an external radio or amplifier and (ii) be filled with a compound that holds the PCB in place and provides heat transfer from a set of passive components on the PCB to a rigid shell of the connector, wherein the PCB is disposed within the rigid shell of the connector.

2. The antenna assembly of claim 1, further comprising:

an over-molding assembly configured to provide strain relief for the conductor by providing a molding around at least portions of the connector and conductor.

3. The antenna assembly of claim 1, wherein the conductor forms a monopole antenna.

4. The antenna assembly of claim 3, wherein the monopole antenna provides communication at a frequency range spanning three or more bandwidth octaves.

5. The antenna assembly of claim 3, wherein the monopole antenna provides communication with less than a 3:5:1 voltage standing wave ratio (VSWR).

6. The antenna assembly of claim 1, wherein the PCB has a cutout for coupling a center pin thereto.

7. The antenna assembly of claim 1, wherein the PCB comprises a matching network, the matching network being a passive radio frequency (RF) matching circuit.

8. The antenna assembly of claim 7, wherein:

the conductor is formed within at least a portion of a coaxial cable, and the conductor is a metallic sheath or braid.

9. The antenna assembly of claim 8, wherein an end of the metallic sheath or braid is electrically connected to the matching network.

10. The antenna assembly of claim 3, wherein the monopole antenna is attached to a garment such that the monopole antenna flexibly bends around a portion of the garment.

11. The antenna assembly of claim 1, wherein the connector is coupled, via another connector of the radio or amplifier, to the radio or amplifier without any intervening adapters.

12. The antenna assembly of claim 1, wherein:

a length of the conductor is at least $1/8^{th}$ of a wavelength of a lowest operating frequency of the reception or emission of the electromagnetic radiation, and the PCB comprises one or more of a resistor, inductor, and capacitor each selected based on the length of the conductor.

13. The antenna assembly of claim 1, further comprising:

a non-conducting jacket configured to enclose the conductor.

* * * * *